US009528356B2

(12) United States Patent
Russo et al.

(10) Patent No.: US 9,528,356 B2
(45) Date of Patent: Dec. 27, 2016

(54) FLOW CONTROL MECHANISM FOR DOWNHOLE TOOL

(71) Applicant: HALLIBURTON ENERGY SERVICES, INC., Houston, TX (US)

(72) Inventors: Christopher Dale Russo, Lafayette, LA (US); Carl Blane Miller, Broussard, LA (US); David J. Tilley, Franklin, LA (US)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 123 days.

(21) Appl. No.: 14/413,162

(22) PCT Filed: Mar. 5, 2014

(86) PCT No.: PCT/US2014/020847
§ 371 (c)(1),
(2) Date: Jan. 6, 2015

(87) PCT Pub. No.: WO2015/134014
PCT Pub. Date: Sep. 11, 2015

(65) Prior Publication Data

US 2016/0273322 A1 Sep. 22, 2016

(51) Int. Cl.
*E21B 34/14* (2006.01)
*E21B 43/12* (2006.01)
(Continued)

(52) U.S. Cl.
CPC ..... *E21B 43/12* (2013.01); *E21B 23/006* (2013.01); *E21B 34/12* (2013.01); *E21B 34/14* (2013.01);
(Continued)

(58) Field of Classification Search
CPC ..... E21B 43/12; E21B 34/12; E21B 34/14; E21B 34/063
See application file for complete search history.

(56) References Cited

U.S. PATENT DOCUMENTS 3,993,130 A 11/1976 Papp
5,012,871 A * 5/1991 Pleasants ..... E21B 17/06 166/127
(Continued)

FOREIGN PATENT DOCUMENTS

| | | |
|---|---|---|
| EP | 2060736 | 5/2009 |
| WO | 9747850 | 12/1997 |
| WO | 2004072434 | 8/2004 |

OTHER PUBLICATIONS

An Innovative Ball-Activated Multi-Cycle Circulation Valve for Completion and Drilling Applications; http://www.onepetro.org/mslib/app/Preview.do?paperNumber=SPE-166777-MS&society: published Oct. 2013.
(Continued)

*Primary Examiner* — William P Neuder
(74) *Attorney, Agent, or Firm* — Polsinelli PC

(57) ABSTRACT

Flow control mechanism (100) for a downhole tool includes a housing (102), an inner liner (104), and a rotatable sleeve (106). The inner liner (104) is provided in and remains stationary relative the housing (102). The rotatable sleeve (106) can be arranged to rotate about the inner liner (104) to provide a closed configuration (900), a first open configuration (1400), and a second open configuration (1900). The closed configuration (900) can enable through-flow of fluid through the flow control mechanism (100) to a distal tool (50). The first open configuration (1400) can enable partial through-flow of fluid through the flow control mechanism (100) to the distal tool (50) and partial through-flow of fluid in a substantially radial direction. The second open configu-
(Continued)

ration (1900) can prevent through-flow of fluid through the flow control mechanism to the distal tool (50) and to enable through-flow of fluid in a substantially radial direction.

20 Claims, 20 Drawing Sheets

(51) Int. Cl.

| | |
|---|---|
| ***E21B 34/12*** | (2006.01) |
| ***E21B 23/00*** | (2006.01) |
| *E21B 34/06* | (2006.01) |
| *E21B 34/00* | (2006.01) |

(52) U.S. Cl.
CPC ..... *E21B 34/063* (2013.01); *E21B 2034/007* (2013.01)

(56) References Cited

U.S. PATENT DOCUMENTS

| | | | |
|---|---|---|---|
| 5,020,600 | A | 6/1991 | Coronado |
| 5,343,949 | A | 9/1994 | Ross et al. |
| 5,597,042 | A | 1/1997 | Tubel et al. |
| 5,609,178 | A | 3/1997 | Hennig et al. |
| 5,695,009 | A | 12/1997 | Hipp |
| 6,173,795 | B1 | 1/2001 | McGarian |
| 6,397,949 | B1 | 6/2002 | Walker et al. |
| 6,520,257 | B2 | 2/2003 | Allamon et al. |
| 6,695,066 | B2 | 2/2004 | Allamon et al. |
| 7,416,029 | B2 | 8/2008 | Telfer et al. |
| 7,866,397 | B2 | 1/2011 | Lee |
| 8,245,788 | B2 | 8/2012 | Garcia et al. |
| 8,307,902 | B2 | 11/2012 | Telfer |
| 2004/0154806 | A1 | 8/2004 | Bode et al. |
| 2004/0221997 | A1 | 11/2004 | Giroux et al. |
| 2005/0072572 | A1 | 4/2005 | Churchill |
| 2005/0230119 | A1 | 10/2005 | McGarian et al. |
| 2007/0017679 | A1 | 1/2007 | Wolf et al. |
| 2008/0223587 | A1 | 9/2008 | Cherewyk |
| 2011/0203809 | A1 | 8/2011 | Knobloch et al. |
| 2013/0025876 | A1 | 1/2013 | McCoy et al. |
| 2013/0118732 | A1 | 5/2013 | Chauffe et al. |
| 2013/0222148 | A1 | 8/2013 | Gano et al. |
| 2013/0248201 | A1 | 9/2013 | Jackson |

OTHER PUBLICATIONS

International Search Report and Written Opinion mailed Dec. 2, 2014; in PCT patent application No. PCT/US2014/020847.

* cited by examiner

FLOW CONTROL MECHANISM FOR DOWNHOLE TOOL

CROSS-REFERENCE TO RELATED APPLICATIONS

This application is a national stage entry of PCT/US2014/020847 filed Mar. 5, 2014, said application is expressly incorporated herein in its entirety.

FIELD

The present disclosure relates generally to flow control mechanisms for downhole tools.

BACKGROUND

In oil drilling, downhole tools can be controlled from the surface using a variety of different techniques. In one example, the downhole tool can be controlled via telemetry via mud pulses. In another example, the downhole tool can be controlled by dropping a ball to cause the tool to operate. Also, an electronic or electromagnetic wave can be used to operate the tool.

BRIEF DESCRIPTION OF THE DRAWINGS

Embodiments of the present disclosure will now be described by way of example with reference to attached figures, wherein.

DETAILED DESCRIPTION

Figure 1:
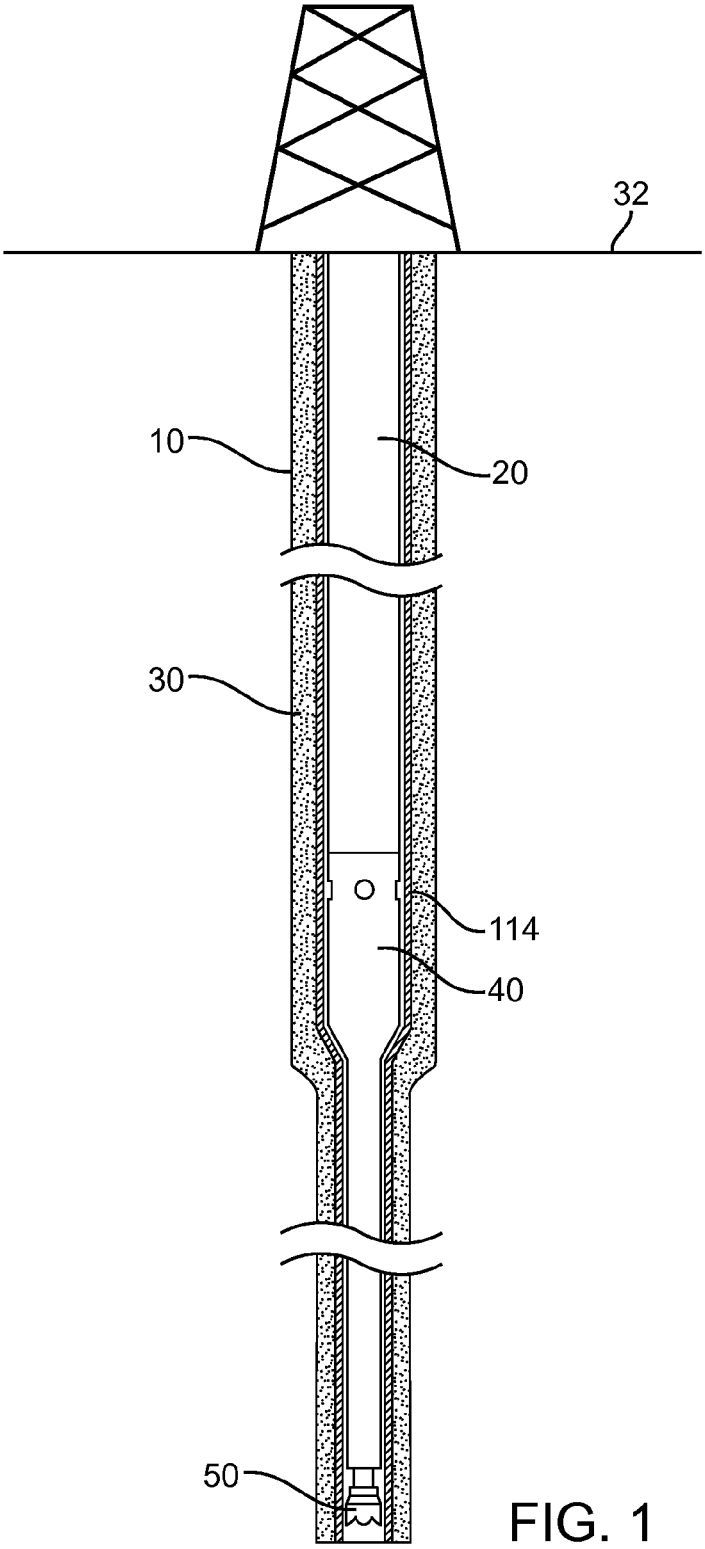
FIG. 1 is a depiction of a wellbore drilling environment in accordance with an example embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following disclosure, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it can be deviated or horizontal. Correspondingly, the transverse, axial, lateral, longitudinal, radial, etc., orientations shall mean orientations relative to the orientation of the wellbore and/or drilling tool and/or relevant portion of a drilling tool being described.

The present disclosure relates to a flow control mechanism for a drilling tool in a wellbore drilling environment. The flow control mechanism is a balldrop-controlled system which provides various operating configurations which include a closed configuration, a first open configuration, and a second open configuration.

Initially, the flow control mechanism can be set in a closed configuration. A closed configuration is configured to enable through-flow of fluid through the inner lining of the tool to a drilling bit or another portion of the drillstring downstream of the tool.

A first open configuration can be in response to dropping of a ball in the flow control mechanism when the flow control mechanism is in the closed configuration. The first open configuration can be configured to enable partial through-flow of fluid through the housing to the drilling bit or another portion downstream of the tool and partial through-flow of fluid in a substantially radial direction. The substantially radial direction as used herein refers to the flow of flow in a direction that is at least partially radial with respect to the tool.

The second open configuration may be established from the first open configuration in response to the dropping of a second ball in the mechanism. The second open configuration is configured to disable through-flow of fluid through the housing to the drilling bit and to enable through-flow of fluid to the annulus.

The closed configuration may be reestablished from the second open configuration in response to the dropping of a third ball in the mechanism. Again, the closed configuration is configured to enable through-flow of fluid through the housing to a drilling bit arranged downstream of the tool, and to disable through-flow to an annulus. The different configurations may be cycled through repeatedly.

In the above description, an order has been given between the closed, first open configuration, and the second open configuration. In other examples, the order of the configurations can change. For example, the flow control mechanism can start in a first open configuration and then move to a second open configuration followed by the closed configuration and repeating the cycle. Other configurations of the order are considered within the scope of this disclosure. Further, as presented herein, the closed configuration is present in every third configuration. In other embodiments, the closed configuration can be present every fifth configuration or according to some other predetermined arrangement as appropriate. The same is true for the first open configuration and second open configuration.

The flow control mechanism of the present disclosure can include a housing, an inner liner, and a rotatable sleeve. The inner liner can be provided in and remains stationary relative the housing. The rotatable sleeve can be arranged to translate and rotate about the inner liner in different positions in response to the dropping of balls in the flow control mechanism. These different positions correspond to the different operating configurations provided by the flow control mechanism.

The rotatable sleeve can have a slot which is pinned from the housing. The slot can be formed all the way around the rotatable sleeve, so that the different configurations of the flow control mechanism may be repeatedly cycled through. The different configurations and cycles can be configured as described herein. To facilitate repositioning, a biasing mechanism can be configured to bias the rotatable sleeve in an uphole direction.

A flow control mechanism can include a first retractable ball seat and a second retractable ball seat. The first ball seat can include a first set of balls that can be exposed within an inside of the inner liner. Similarly, the second ball seat can include a second set of balls exposed in the inner liner, and these balls can be positioned downstream from the first set of balls. The first retractable ball seat and the second retractable ball seat can be configured to be other types of retractable ball seats that allows for passage of an actuation ball.

An actuation ball that is utilized to drop into the flow control mechanism can land on, and be seated by, the first ball seat. The actuation ball can be stopped from further downhole movement by the first ball seat and not allowed to pass, thereby substantially blocking through-flow of fluid through the flow control mechanism to a downhole portion of the drillstring, for example a bit. The blockage of through-flow of fluid can cause pressure to develop upstream of the actuation ball. Once the pressure upstream of the actuation ball is greater than the resistance pressure provided by the biasing mechanism, the rotatable sleeve can translate and rotate with respect to the housing based on the configuration of the slot. In at least one example, the slot can be described as a J-slot that has a long portion in every third actuated configuration. On the other hand, an actuation ball that can land on and be seated by the second ball seat, thereby blocking through-flow of fluid to the drilling bit but not causing movement of the rotatable sleeve in response to the pressure uphole of the actuation ball seated on the second ball seat.

Further detail regarding the flow mechanism is presented herein to provide examples of implementation of the flow control mechanism. The flow control mechanism can include one or more of the features as presented herein. The examples as provided herein are merely examples and other features can be included.

In the environment of oil and gas exploration as depicted in FIG. 1, a wellbore 10 can be drilled through a formation from the surface 32 to gain access to various subterranean deposits. During the drilling operation, drilling fluid can be pumped downhole through the drillstring 20 to a distal tool 50. In the illustrated example, the distal tool 50 can be a drill bit. Additionally, the drilling fluid can pass through a tool 40 having a flow control mechanism located therein. In at least one embodiment, the drill fluid and cuttings from the drill bit flow upward through an annulus 30 formed between the drillstring 20 and the wellbore 10. During the drilling procedure the downhole tool 40 can be configured to enable fluid to flow to the distal tool 50. The downhole tool 40 can also be configured to enable fluid to flow out through flow ports 114 formed in the tool 40. As illustrated, fluid can flow out through the flow ports 114 thereby providing additional flow into the annulus at a given depth. The drilling fluid also functions to cool the drilling bit 50 during drilling, and to balance hydrostatic formation pressures. Thus, the operator of the well can choose to open and close flow to the distal tool 50 as well as flow through the flow ports 114 into the annulus. Details regarding the opening and closing of the flow ports 114 will be presented herein in relation to the flow control device. While only a single set of flow ports 114 are present in FIG. 1, the tool 40 can have one or more sets of flow ports 114.

Figure 2:
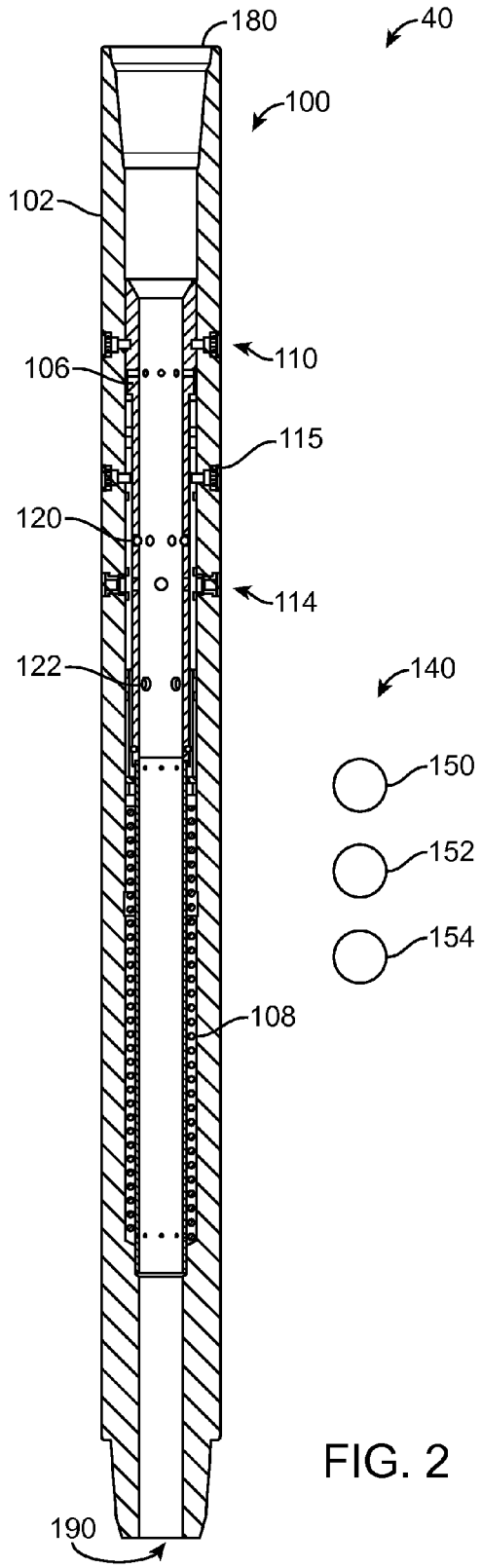
FIG. 2 is a cross-sectional view of a flow control mechanism of a tool with a plurality of activation balls in accordance with an example embodiment.

Referring now to the cross-sectional view of FIG. 2, a flow control mechanism 100 of a drilling tool 40 is illustrated. The flow control mechanism 100 can be a balldrop-controlled system which utilizes a plurality of balls 140 for setting of different operating configurations.

In this example, a cycle of the flow control mechanism 100 can make use of three (3) activation balls, namely, a first activation ball 150, a second activation ball 152, and a third activation ball 154, for the setting of three (3) different operating configurations. In some examples, activation balls 150, 152, and 154 can be non-deformable and can have the same make and size (for example, they may be identical to each other). Also, activation balls 140 can be made of steel. In other embodiments, the activation balls 140 can be made of a frangible material or other desired material that provides sealing of the downhole fluid flow path.

In FIG. 2, the flow control mechanism 100 can include a housing 102, an inner liner 104, and a rotatable sleeve 106. The inner liner 104 can be provided in and remains stationary relative the housing 102. The rotatable sleeve 106 can be configured to rotate about the inner liner 104 in different positions in response to the dropping and passage of activation balls 140 into the flow control mechanism 100. These positions correspond to the different operating configurations provided by mechanism 100.

A biasing mechanism 108 can be coupled to the rotatable sleeve 106. In the illustrated example, the biasing mechanism can be attached to and extends from the rotatable sleeve 106. The biasing mechanism 108 can configured to bias the rotatable sleeve 106 in an upstream direction. Normally, the rotatable sleeve 106 can be maintained in a retained position by the biasing mechanism 108. In at least one embodiment, the biasing mechanism 108 can be a spring based mechanism. In other embodiments, the biasing mechanism 108 can be a hydraulic biasing mechanism.

The biasing mechanism 108 can be configured to provide a resistance pressure, such that the motion of the rotatable sleeve 106 is prevented unless a predetermined downward force is present. For example, the biasing mechanism 108 can be configured to supply a predetermined pressure in an upward direction to the rotatable sleeve 106. Once the rotatable sleeve 106 exerts more than the predetermined pressure against the biasing of biasing mechanism 108, the rotatable sleeve 106 can be driven lengthwise downstream and to rotate into an intermediate, non-retained position. When the pressure is released, biasing mechanism 108 causes rotatable sleeve 106 to move lengthwise uphole and to rotate into the next position, which can correspond to the next operating configuration.

Additionally, as illustrated, the flow control mechanism 100 can also include an inner lining retaining pin 110 that retains the inner liner 104 from motion relative to the housing 102. Additionally, the flow control mechanism 100 can include rotating sleeve pins 115. Rotating sleeve pins 115 permit translation and rotation of the rotating sleeve relative to the housing 102, while restricting the motion of the rotating sleeve 104 to a predetermined path established by a slot formed in an exterior of the rotating sleeve.

As discussed above, the flow control mechanism 100 can include flow ports 114 that enable fluid to flow in a substantially radial direction. The flow ports 114 enable the flow control mechanism 100 to divert fluid that enters the flow control mechanism 100 at an upstream end 180 and divert at least a portion of the fluid before it reaches a downstream end 190.

Figure 3:
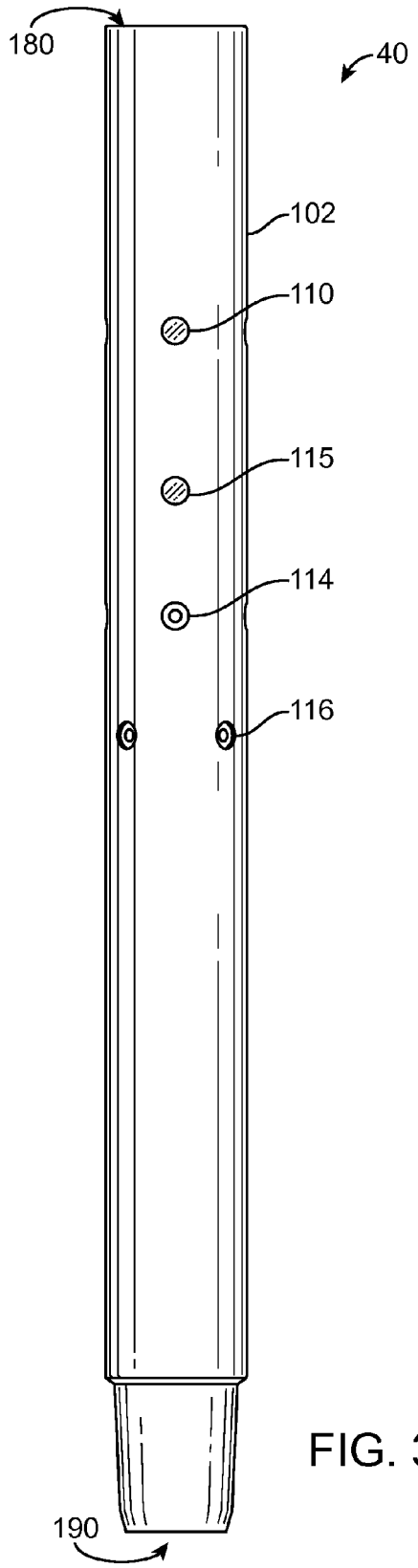
FIG. 3 is a perspective view of the housing of the flow control mechanism in accordance with an example embodiment.

FIG. 3 illustrates a perspective view of the housing 102 of the tool 40 having the flow control mechanism inside in accordance with an example embodiment. As illustrated, the tool can include an uphole end 180 and a downhole end 190 such that fluid enters the uphole end and exits via the downhole end 190 to a distal tool. The lining pins 110 secure the inner liner to the housing 102 to prevent relative movement of the inner liner relative to the housing. The rotatable sleeve pins 115 are illustrated that retain the inner sleeve relative to the housing 102 and permit relative rotation of the inner sleeve relative to the housing 102. Additionally, the tool can include flow ports (114, 116). As illustrated, the flow ports (114, 116) can be configured such that a second set of flow ports 116 are located downhole relative to a first set of flow ports 114. As illustrated, the second set of flow ports 116 can be offset relative to the first set of flow ports 114 in an azimuthal direction. When the second set of flow ports 116 is offset relative to the first set of flow ports 114, the flow control mechanism can provide a more uniform annular flow. In other embodiments, only a single set of flow ports 114 can be provided. In other embodiments, the flow ports 114 can be spaced apart both in an azimuthal and longitudinal direction depending on the intended purpose of the tool 40.

Figure 4:
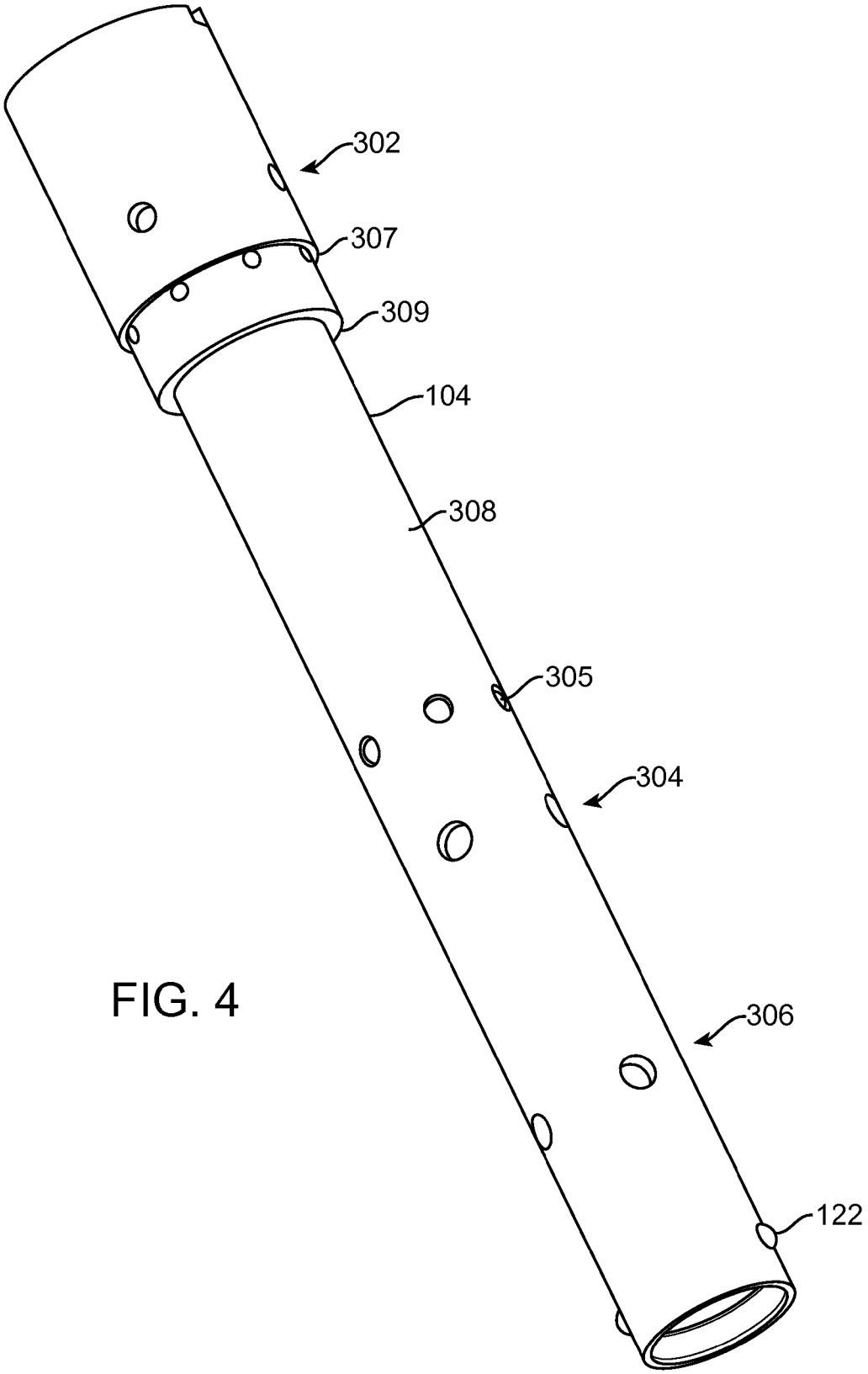
FIG. 4 is a perspective view of the inner liner of the flow control mechanism in accordance with an example embodiment.

FIG. 4 is a perspective view of the inner liner 104 of the flow control mechanism in accordance with an example embodiment. As illustrated, the inner liner 104 can have a plurality of apertures. The inner lining 104 can include liner pin receivers 302 formed in the inner liner 104. The liner pin receivers 302 are configured to receive the liner pins, which are configured to hold the inner liner 104 in a fixed position relative to the housing. Additionally, the inner liner 104 includes upper port apertures 304 corresponding to the first set of flow ports and a lower port apertures 306 corresponding to the second set of flow ports. Furthermore, the plurality of apertures can include a first set of ball seat apertures 305 that enable a ball to protrude into the inner portion of the inner liner to thereby form a first ball seat. Also, apertures can be formed in the inner liner 104 to receive the second set of balls 122 that form the second ball seat.

The flow control mechanism further includes first and second retractable ball seats exposable in the inner liner 104. The first ball seat includes a first set of balls exposable through the first set of ball seat apertures 305 of the inner liner 104. Similarly, the second ball seat includes a second set of balls 122 exposable through apertures of the inner liner 104. These first and second ball seats can be referred to as retractable ball seats, as they enable an activation ball to pass once a predetermined criteria is satisfied.

The inner liner 104 also includes a portion 308 about which the rotating sleeve can rotate. A first lip 307 and a second lip 309 can be configured to abut a top portion of the rotating sleeve and prevent the rotating sleeve from moving uphole based upon pressure received from the biasing mechanism.

Figure 5:
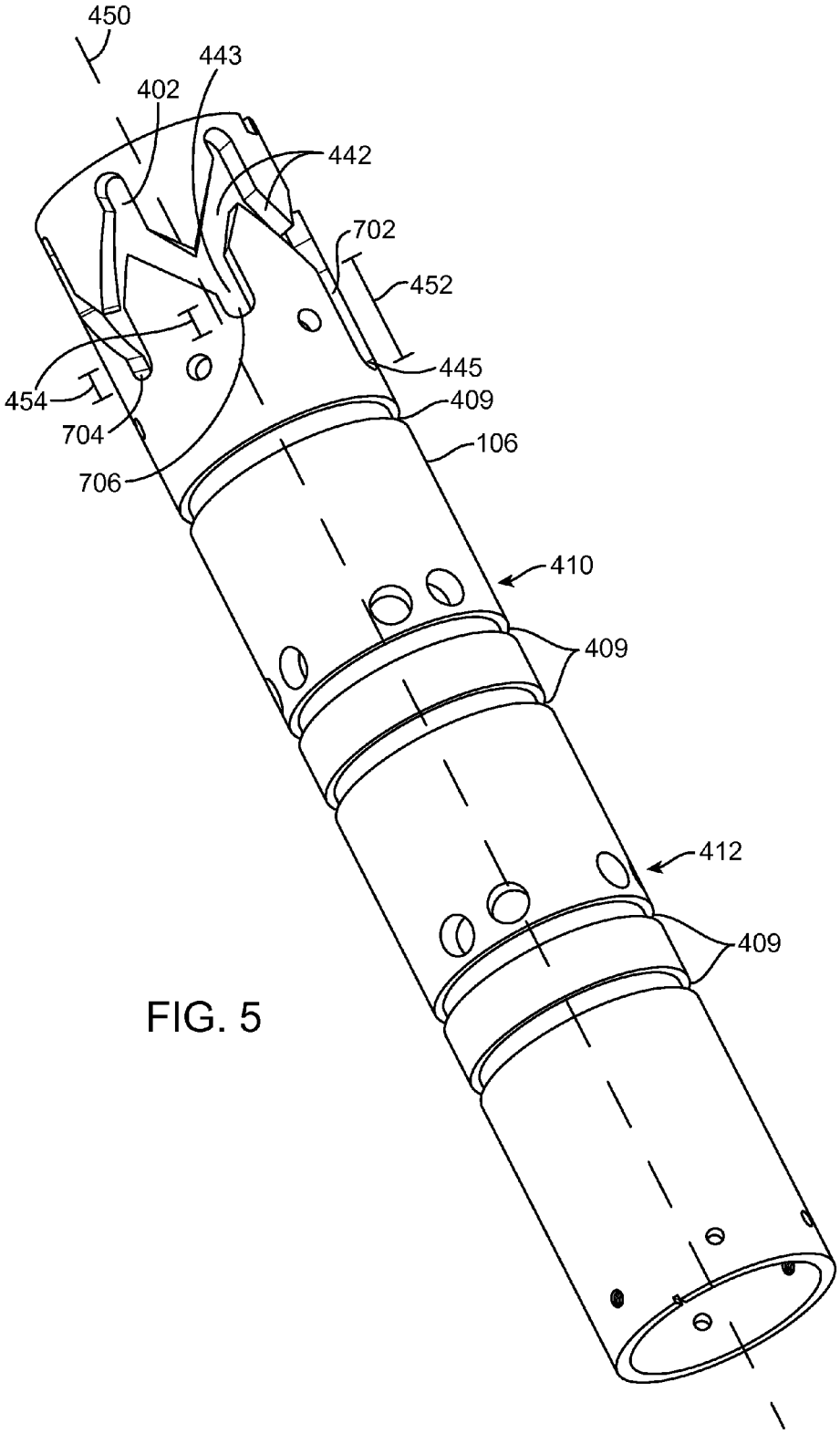
FIG. 5 is a perspective view of the rotatable sleeve of the flow control mechanism in accordance with an example embodiment.

FIG. 5 is a perspective view of the rotatable sleeve 106 of the flow control mechanism in accordance with an example embodiment. To help provide the rotation and different configuration positions, the rotatable sleeve 106 can have a slot 402 formed therearound. The slot 402 can be pinned by pins extending from the housing. The slot 402 can be formed all the way around the rotatable sleeve 106, so that the different configurations of the mechanism can be cycled through repeatedly based on the configuration of the slot 402.

The rotatable sleeve 106 can also include seal receiving grooves 409 formed about the circumference of the rotatable sleeve 106. The seal receiving grooves 409 are configured to receive seals that provide for sealing while being able to rotate and translate about the housing. Additionally, the rotating sleeve can include a plurality of apertures (410, 412) formed therein to enable passage of fluid from the inner lining to the ports formed in the housing. As illustrated, a top set of apertures 410 can be present and corresponds to the upper port apertures of the inner lining and the first set of flow ports of the housing. Similarly, a bottom set of apertures 412 can be present and correspond to the lower port apertures of the inner lining and the second set of flow ports of the housing. The top set of apertures 410 and bottom set of apertures 412 can be configured to enable fluid to flow in a substantially radial direction based upon the position of a pin within slot 402.

The slot 402 that is formed in the rotatable sleeve 106, and the plurality of apertures (410, 412), can be configured to allow one or more activation balls that are received at the flow control mechanism to pass therethough and align the plurality of apertures (410, 412) so as to allow fluid to pass through the plurality of apertures (410, 412). As illustrated, the slot 402 can include one or more circumferential portions 442 that allow the rotatable sleeve 106 to rotate about the longitudinal axis 450 of the rotatable sleeve 106. The one or more circumferential portions 442 can be configured to allow for both rotation and translation or just translation. Additionally, the slot 402 can include one or more axial portions 445. The one or more axial portions 445 can be configured to restrict the motion of the sleeve to a substantially axial direction.

As described in detail below, the one or more axial portions 445 can be configured to have different lengths (452, 454). In the illustrated example, two slot portions (704, 706) have a first length 454 that is shorter than the length 452 of slot 702. In at least one example the first length 454 is just slightly larger than the width of the slot 402. Additionally, in at least one example, the second length 452 is about three times longer than the first length 454. Thus, the slot 402 has both a circumferential component and an axially oriented component. With both a circumferential and axially configured slot 402, the plurality of apertures (410, 412) can be aligned to provide for fluid passage; and a ball seat can be retracted and deployed, thereby allowing one or more activation balls to serve to block an interior passage as well as function to cause the rotatable sleeve 106 to rotate in response to pressure inside of the flow control mechanism.

Figure 6:
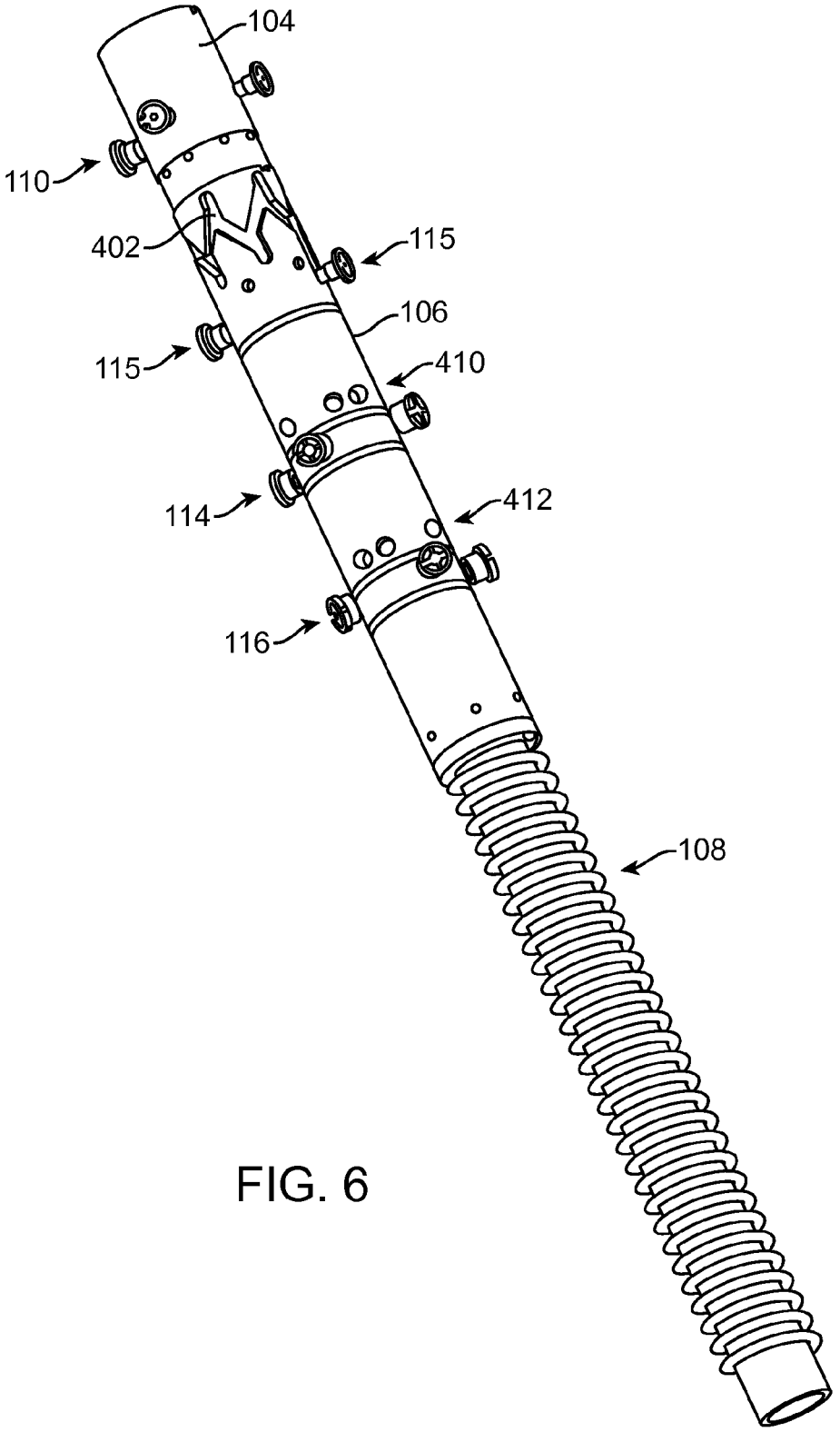
FIG. 6 is another perspective view of the rotatable sleeve, with a biasing mechanism extending therefrom and the housing hidden from view in accordance with an example embodiment.

FIG. 6 is another perspective view of the rotatable sleeve 106, with a biasing mechanism 108 extending therefrom and the housing hidden from view in accordance with an example embodiment. As illustrated, the rotating sleeve 106 can be configured to be about a portion of the inner lining 104. As illustrated, the inner lining retaining pin 110 can be configured to fix the inner liner 104 to the housing. Additionally a slot 402 is formed in the outer surface of the rotating sleeve 104 and configured to receive rotating sleeve pins 115. Additionally, a top set of apertures 410 are illustrated and they are configured to correspond to the first set of flow ports 114 in the first open configuration and second open configuration. As illustrated, the rotating sleeve 106 is in the closed configuration such that first set of flow ports 114 do not align with the top set of apertures 410 and the top flow ports 114 can be sealed from the top set of apertures 410 by a seal (not shown). Likewise, the top flow ports 114 are sealed from the bottom set of apertures 412 by a seal. The second set of flow ports 116 are also configured to not be in fluid communication with the bottom set of apertures 412 and the second flow ports 116 can be sealed from the bottom set of apertures 412.

As the rotatable sleeve 106 moves into the first and second open configurations, the first set of flow ports 114 can be substantially aligned with a respective one of the top set of apertures 410. Additionally, when a second set of flow ports 116 are provided they can substantially align with a bottom set of apertures 412.

Figure 7:
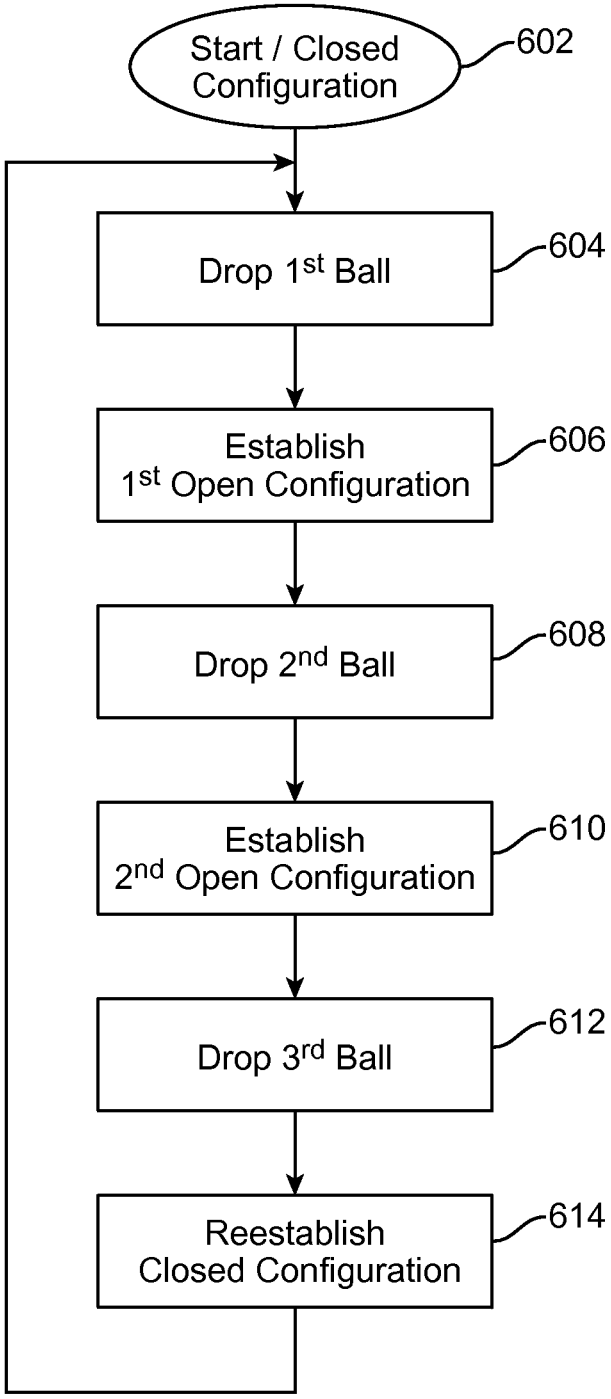
FIG. 7 is a flowchart for use in describing a method of controlling fluid flow with use of a flow control mechanism in accordance with an example embodiment.

FIG. 7 is a flowchart for use in describing a method of controlling flow with use of a flow control mechanism in accordance with an example embodiment. FIG. 7 is a flowchart of a method of controlling flow with use of the flow control mechanism described herein. The flow control mechanism of the present disclosure provides a closed configuration, a first open configuration, and a second open configuration.

The flow control mechanism can be initially set in the closed configuration (see start block 602). The closed configuration is configured to enable through-flow of fluid through a housing to the drilling bit arranged downstream of the tool. In the closed configuration, the flow control mechanism can be configured to prevent flow in a substantially radial direction.

In response to the dropping of a first activation ball in the flow control mechanism (block 604), a first open configuration can established from the closed configuration (block 606). The first open configuration can be configured to enable partial through-flow of fluid through the tool to the downhole tool, and partial through-flow of fluid in a substantially radial direction.

In response to the dropping of a second activation ball in the flow control mechanism (block 608), the second open configuration can be established from the first open configuration (block 610). The second open configuration can be configured to disallow through-flow of fluid through the tool to the downhole tool, and to enable through-flow of fluid in a substantially radial direction. In at least one embodiment, the flow of fluid in the substantially radial direction is substantially all of the flow of fluid. In at least one embodiment, a small flow of fluid can be around the second activation ball in a downhole direction. In establishing the second open configuration, the second activation ball can move from a first ball seat to a second ball seat. The first ball seat can be located uphole of ports that enable fluid to flow in a substantially radial direction, and the second ball seat can be located downhole of the ports that enable fluid to flow in a substantially radial direction.

In response to the dropping of a third activation ball in the flow control mechanism (block 612), the closed configuration can be reestablished from the second open configuration (block 614). Thus, through-flow of fluid can again allowed through the tool to the drilling bit, but fluid to flow in a substantially radial direction can be prevented. Note that these different configurations may be cycled through repeatedly, as indicated in FIG. 7. Additionally, the present disclosure contemplates that additional steps can be included with the method as presented in regards to FIG. 7 based upon the additional description provided herein. Furthermore, if a particular order of the method is implied, the present disclosure includes reordering of the method to provide a desired order to each portion of the method, for example a different order of the three configurations.

Description of the above method of FIG. 7 will now be elaborated upon with reference to the several views presented in relation to FIGS. 8-22.

Figure 8:
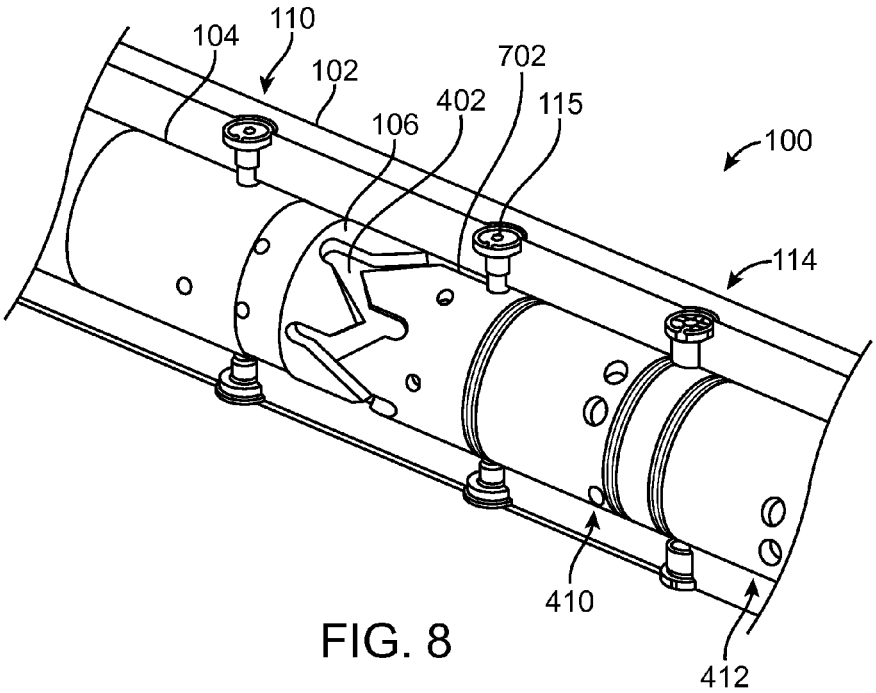
FIG. 8 is a partial perspective view of a flow control mechanism in an initial closed configuration in accordance with an example embodiment.

FIG. 8 is a partial perspective view of a flow control mechanism 100 in an initial closed configuration in accordance with an example embodiment. As illustrated in FIG. 8, the inner liner 104 is retained by inner lining retaining pin 110. The rotatable sleeve 106 has a slot 402 formed on the outer circumference thereof. A rotating sleeve pin 115 can be received in the slot. As illustrated, the rotating sleeve pin 115 is received in a closed configuration notch 702. Also, as illustrated the top set of apertures 410 are not aligned with the first set of flow ports 114. Similarly, the bottom set of apertures 412 are not aligned with the second set of flow ports. The slot 402 can run substantially around the circumference of the rotating sleeve 106.

Figure 9:
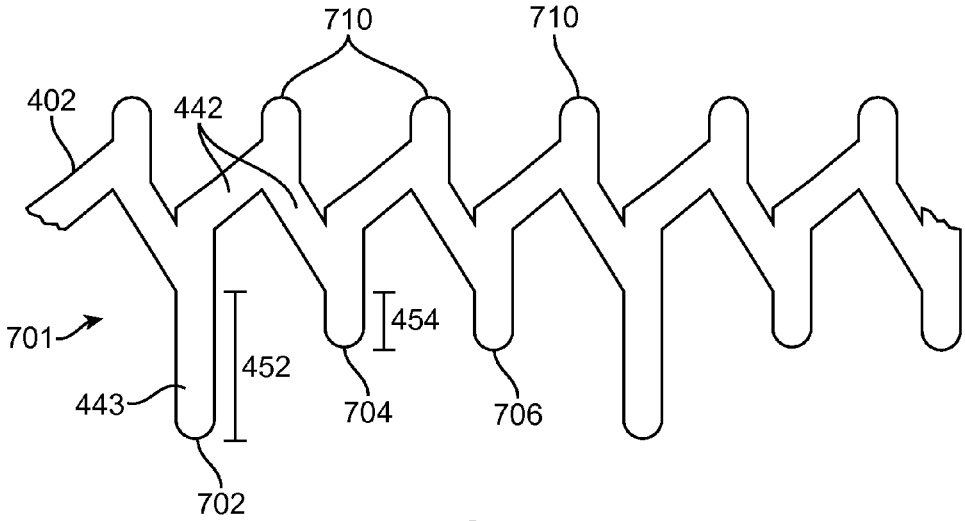
FIG. 9 is a plan view of a slot formed in a rotatable sleeve of a flow control mechanism in accordance with an example embodiment.

FIG. 9 is a plan view of a slot 402 formed in a rotatable sleeve of a flow control mechanism in accordance with an example embodiment. In this example, slot 402 has a plurality of top notch positions 710 which define temporary, intermediate positions. The slot 402 also has a plurality of bottom notch positions 701 which correspond to the different operating configurations. The bottom notch positions 701 include a closed configuration notch position 702, a first open configuration notch position 704, and a second open configuration notch position 706. The closed configuration notch position 702 corresponds to the closed configuration, the first open configuration notch position 704 corresponds to the first open configuration, and the second open configuration notch position 706 corresponds to the second open configuration. These notch positions repeat once around the rotatable sleeve. Note that every third notch position (for example, closed configuration notch position 702) of the slot 402 has an extended length relative to every first and second open configuration notch positions 704 and 706. While in the illustrated embodiment, the notch positions repeat once around the rotating sleeve, the present disclosure contemplates the notch positions can repeat two, three or even more times around the rotatable sleeve. The number of times the notch positions repeats can be determined based on the forces and a diameter of the rotatable sleeve. Additionally, if a different ordering of positions is desired, the slot 402 can be reconfigured along with the apertures (410, 412) to allow for the desired flow pattern.

The slot 402 can also be described as having a circumferential portion 442 and an axial portion 443. The circumferential portion 442 can be configured to couple two axial portions 443. The axial portion 443 can be configured to provide the rotatable sleeve 106 the ability to exclusively translate in the axial direction. In the illustrated example, the axial portion 443 can be configured to have different lengths (452, 454). As illustrated, the axial portion 443 has a first length 454 that is shorter than a second length 452. As illustrated, the first length 454 can be about the same as a width of the slot 402. In other examples the first length 454 can be about twice the width of the slot 402. The second length 452 can be twice the first length 454. In other examples, the second length 452 can be three times the first length 454. The first length 454 and second length 452 can be selected to allow for the desired axial translation. As illustrated, the closed configuration notch position 702 has a length that is the second length 452. Additionally, the first open configuration notch position 704 and the second open configuration notch position 706 can have a length that is the first length 454 to operate as described herein.

Figure 10:
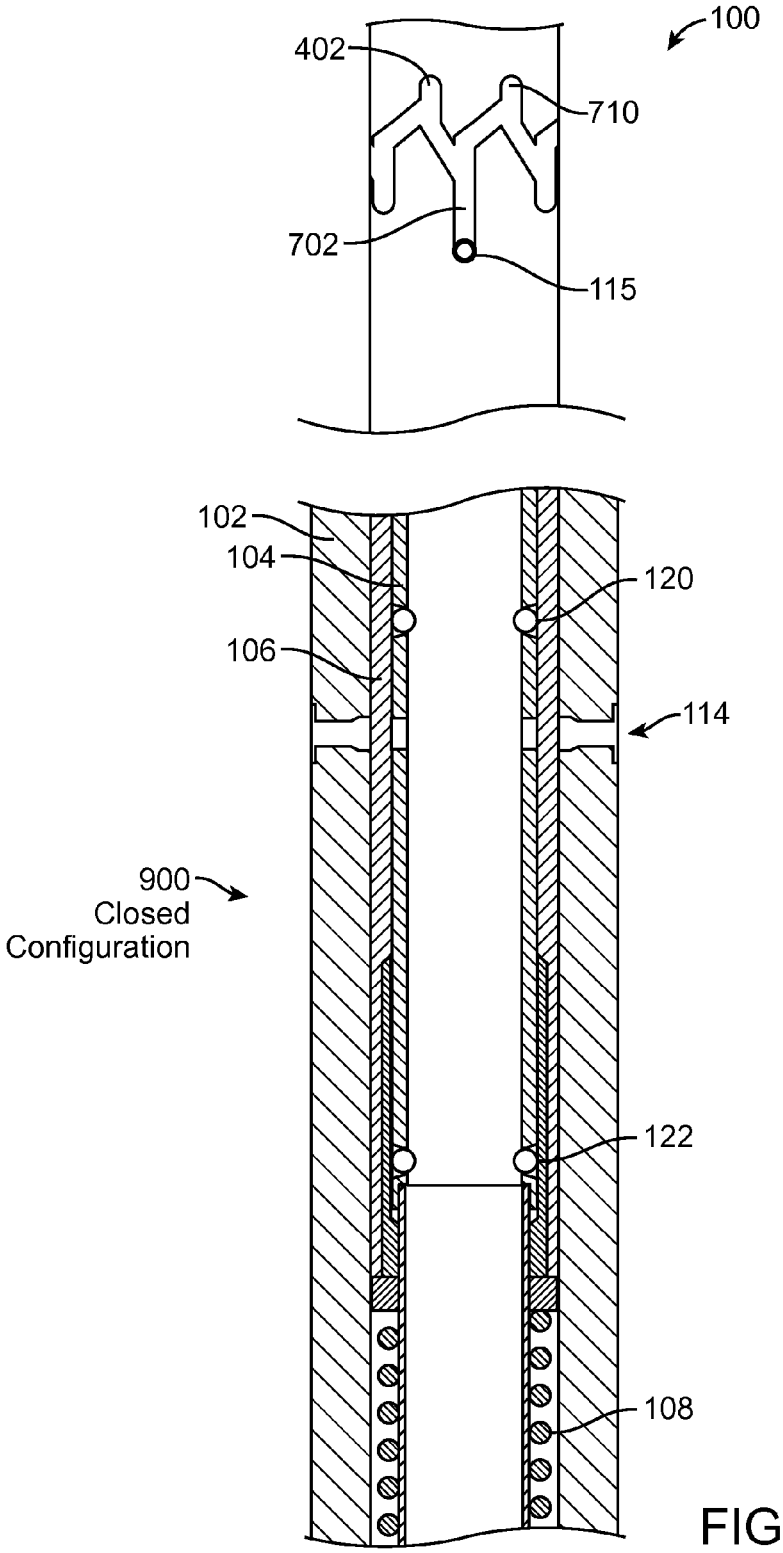
FIG. 10 is a cross-sectional view of a flow control mechanism in the closed configuration in accordance with an example embodiment.

FIG. 10 is a cross-sectional view of a flow control mechanism 100 in the closed configuration 900 in accordance with an example embodiment. As indicated above, in at least one embodiment, the mechanism 100 can be initially set in the closed configuration 900. In other configurations, the flow control mechanism 100 can be set to a different configuration. Rotating sleeve pin 115 can be positioned in the closed configuration notch position 702 of the slot 402.

As illustrated, only a single set of flow ports 114 are illustrated for simplicity of illustration. It is appreciated the present description can also include addition flow ports as mentioned above. The rotatable sleeve 106 is shown as being biased in an uphole direction by biasing member 108. As illustrated, a first ball set comprises a first set of balls 120 and a second ball seat comprises a second set of balls 122. As illustrated, the flow of fluid through the flow control mechanism 100 in the closed configuration can be only in an axial direction.

Figure 11:
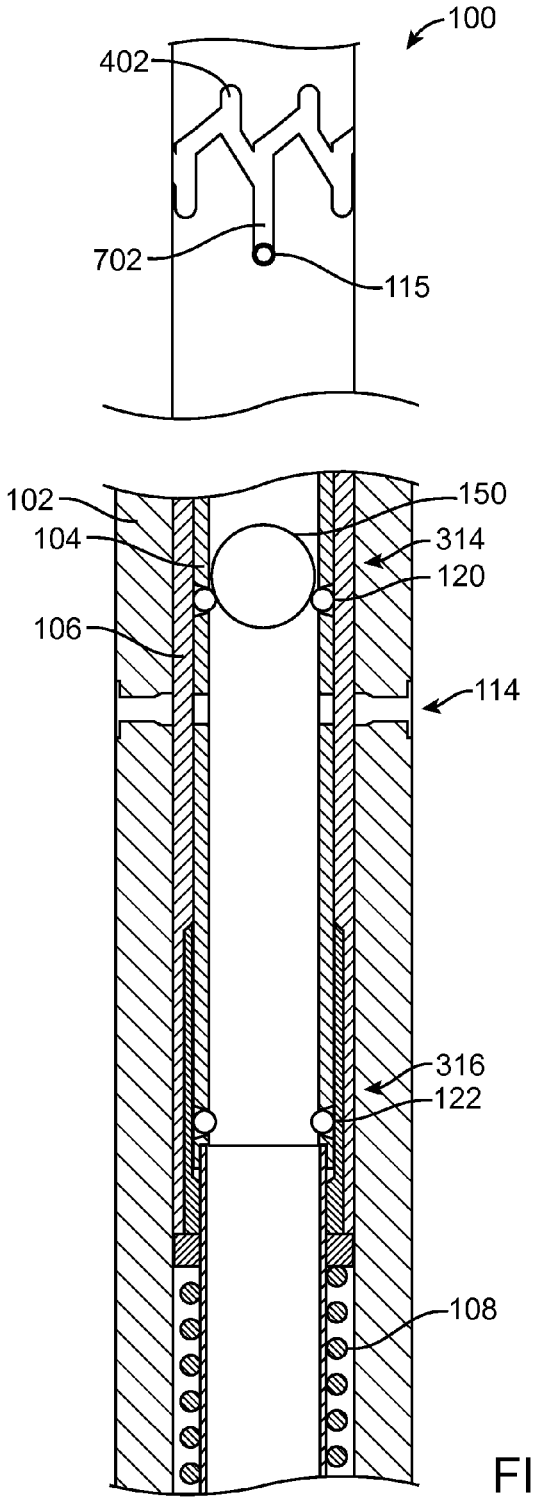
FIG. 11 is a cross-sectional view of a flow control mechanism in the closed configuration, with a first activation ball being seated in a first ball seat, in accordance with an example embodiment.

FIG. 11 is a cross-sectional view of a flow control mechanism 100 in the closed configuration, with a first activation ball 150 ball being seated in a first ball seat 314, in accordance with an example embodiment. An activation ball 150 can be dropped into the flow control mechanism 100. The activation ball 150 can land on and be seated by the first ball seat 314 comprising a first set of balls 120. The second ball seat 316 can also be activated such that is cable of catching the activation ball 150, for example by the second set of balls 122. When the activation ball 150 is seated on the first ball seat 314, the pressure uphole of the activation ball 150 can build. The biasing member 108 continues to resist the movement of the rotatable sleeve 106, until the pressure uphole of the activation ball 150 is greater than the pressure applied by the biasing device 108. As the pressure uphole of the activation ball 150 exceeds the biasing pressure provided by the biasing mechanism 108, the rotatable sleeve 106 translates and rotates relative to the housing 102 and inner liner 104 in dependence upon the slot 402 and rotatable sleeve pin 115 interaction.

Figure 12:
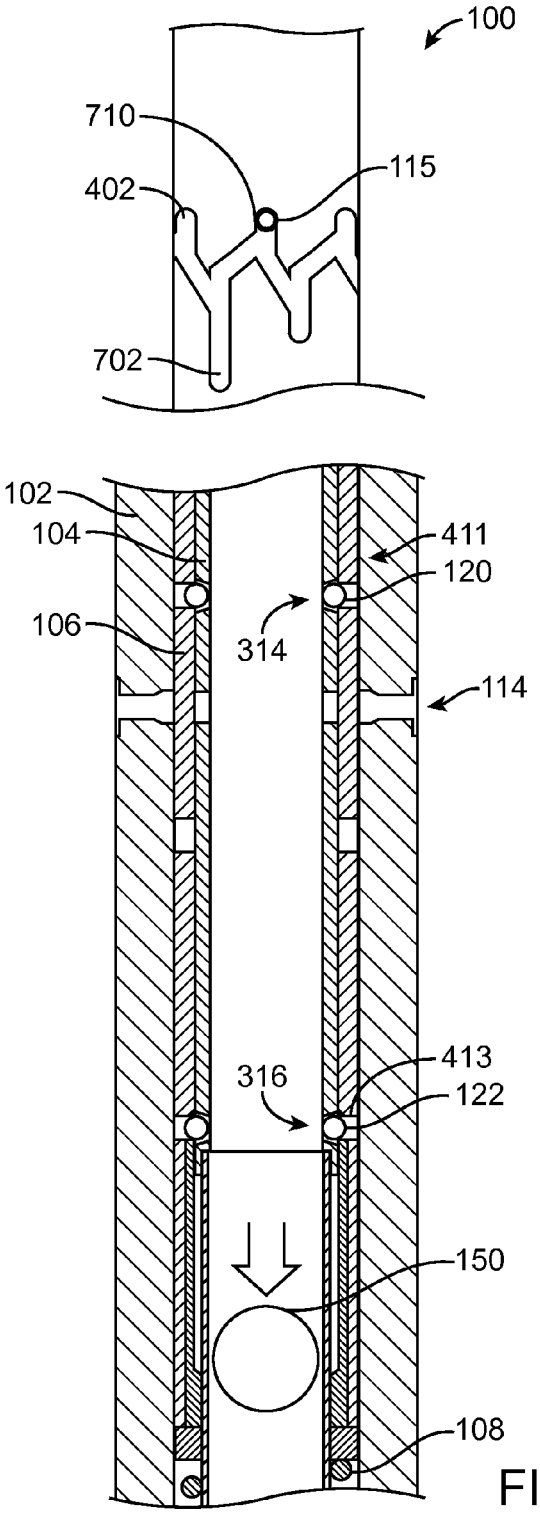
FIG. 12 is a cross-sectional view of a flow control mechanism being repositioned from the closed configuration, where the first activation ball is unseated from first ball seat in accordance with an example embodiment.

FIG. 12 is a cross-sectional view of a flow control mechanism 100 being repositioned from the closed configuration 900, where the first activation ball 150 is unseated from first ball seat in accordance with an example embodiment. Rotatable sleeve pin 115 is temporarily positioned in the first intermediate notch position 710 of the slot 402. The rotatable sleeve 106 can be rotated in a position such that ball receiving apertures (411, 413) provided in rotatable sleeve 106 can align with the first set of balls 120 and the second set of balls 122. Thus, in at least the illustrated configuration, the first set of balls 120 retract within a first set of ball receiving apertures 411 formed in the rotatable sleeve 106. Additionally, the second set of balls 122 retract within a second set of ball receiving apertures 413. When the first set of balls 120 and second set of balls 122 are retracted, they provide for a retractable ball seat, thereby allowing the first activation ball 150 to pass downhole. The first activation ball 150 can be caught downhole by an activation ball catcher (not shown).

The fluid pressure uphole is therefore stopped, and this enables the biasing mechanism 108 to push the rotatable sleeve 106 into the next retained position, with further partial rotation. As illustrated the next retained position is the first open configuration notch position 704.

Figure 13:
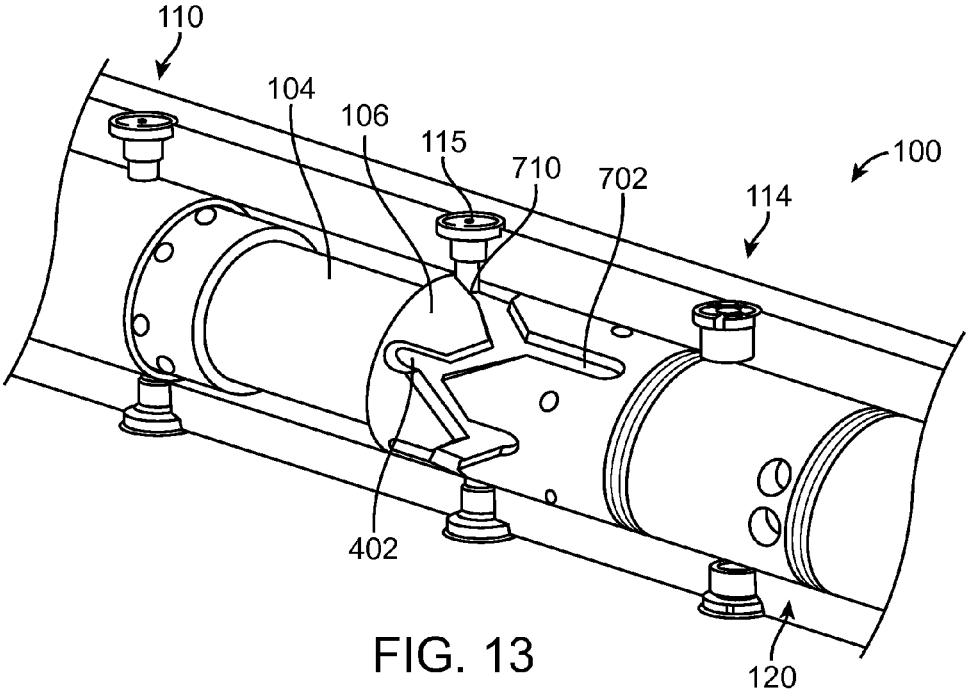
FIG. 13 is a partial perspective view of the flow control mechanism of FIG. 11.
Figure 14:
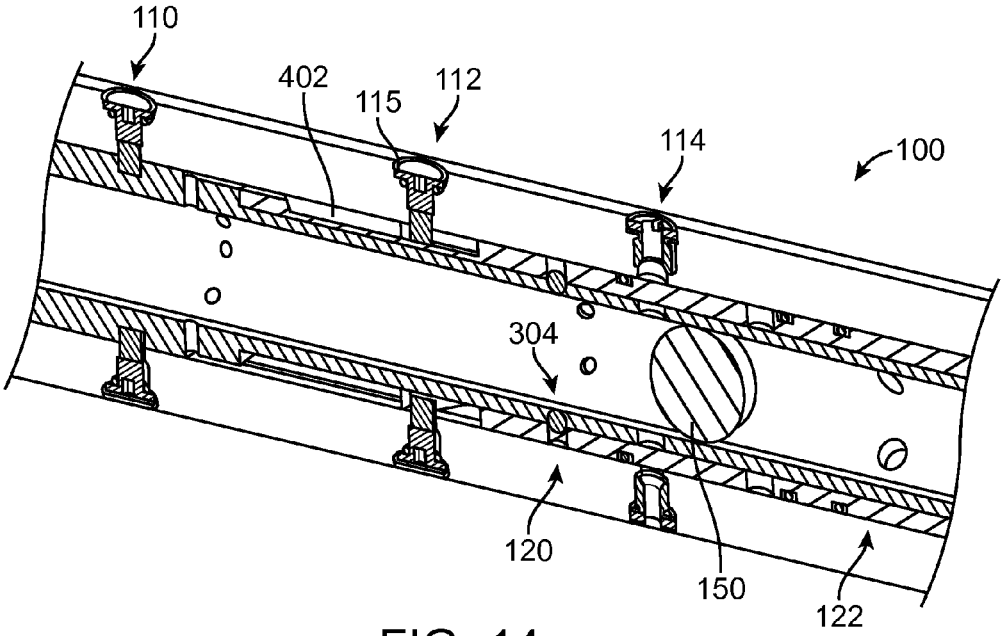
FIG. 14 is another cross-sectional view of the flow control mechanism of FIG. 11.

FIG. 13 is a partial perspective view of that in FIG. 11. FIG. 14 is another cross-sectional view of that in FIG. 11. As seen in these illustrations, when the rotating sleeve pin 117 is positioned at the intermediate notch position 710, a portion of the inner lining 104 is exposed. Additionally, the first set of flow ports 114 are not aligned to provide fluid flow until the rotating sleeve pin 115 reaches the first open configuration notch position 704.

Figure 15:
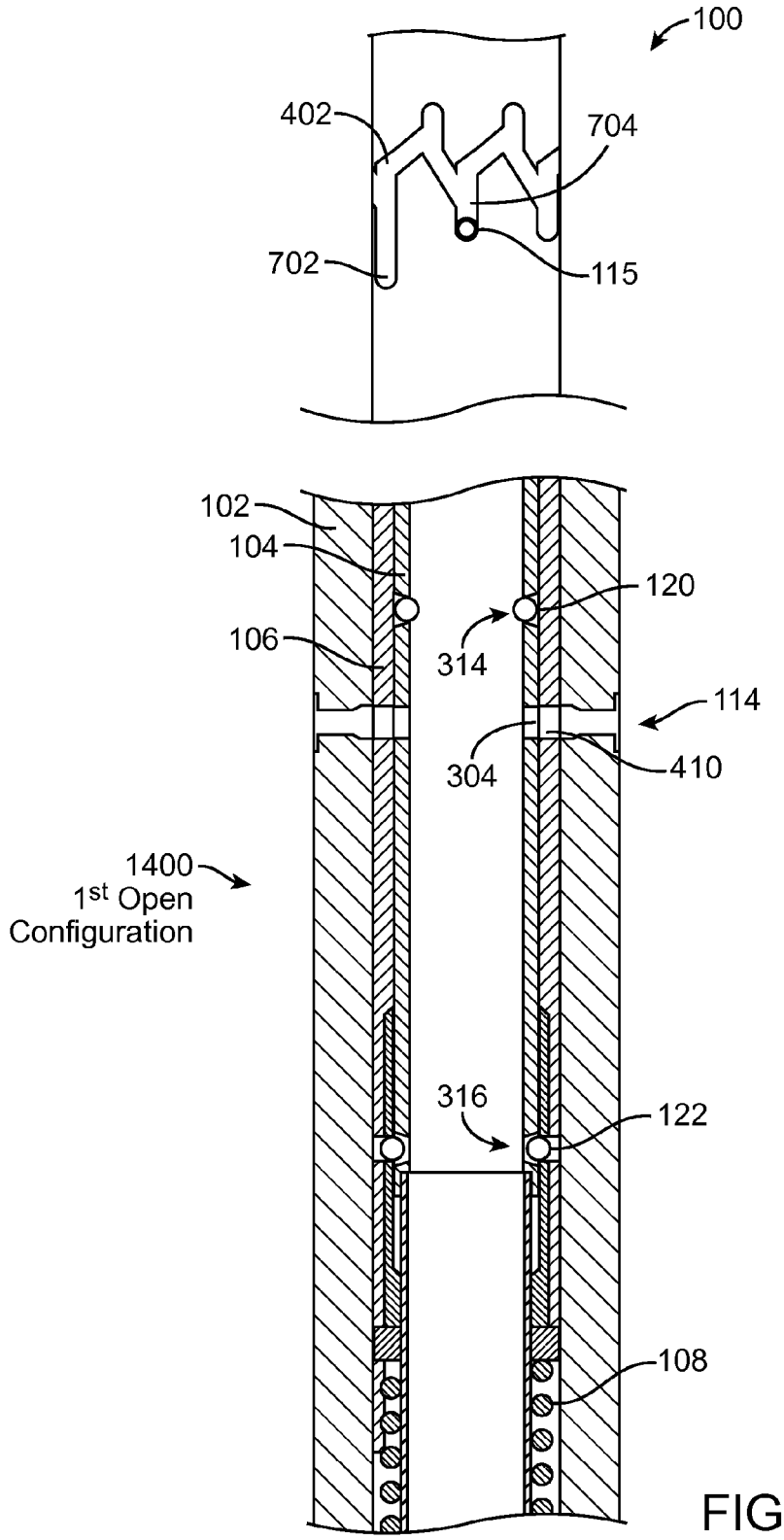
FIG. 15 is a cross-sectional view of a flow control mechanism in a first open configuration, repositioned from the closed configuration in accordance with an example embodiment.

FIG. 15 is a cross-sectional view of a flow control mechanism 100 in a first open configuration 1400, repositioned from the closed configuration in accordance with an example embodiment. As illustrated the rotating sleeve pin 115 is positioned within the first open configuration notch position 704 of the slot 402 which is a shorter slot as compared to the closed configuration notch position 704. In the first open configuration, the first set of flow ports 114 are substantially aligned with the upper port apertures 304 of the inner lining 104 and the top set of apertures 410, thereby establishing a fluid flow path in a substantially radial direction. As illustrated, the fluid flow path is almost entirely radial. In other configurations, the first set of flow ports 114, upper port apertures 304, and top set of apertures 410 can be arranged to allow for a deviated flow path that still allows the fluid to exit the flow control mechanism 100 in a substantially radial direction. Thus, in this first open configuration 1400 there is partial through-flow of fluid to the annulus through the first set of flow ports 114 along with the partial through-flow of fluid through the flow control mechanism to the distal tool. While the flow through the second set of flow ports is not described with respect to FIG. 15, it can be appreciated that the flow through the second set of flow ports if provided can be in a similar fashion through lower port apertures and the bottom set of apertures.

Figure 16:
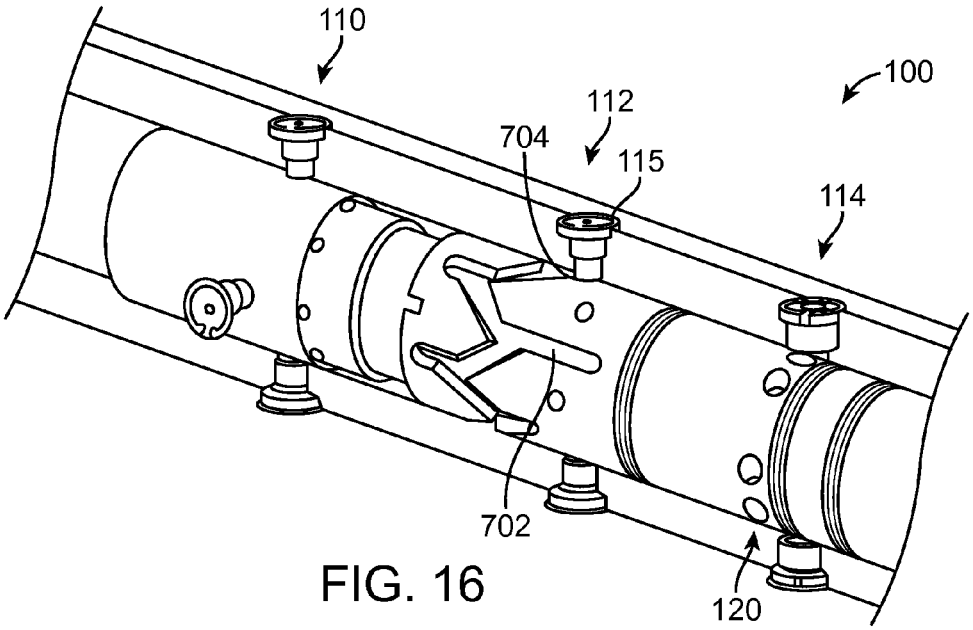
FIG. 16 is a partial perspective view of the flow control mechanism of FIG. 15.
Figure 17:
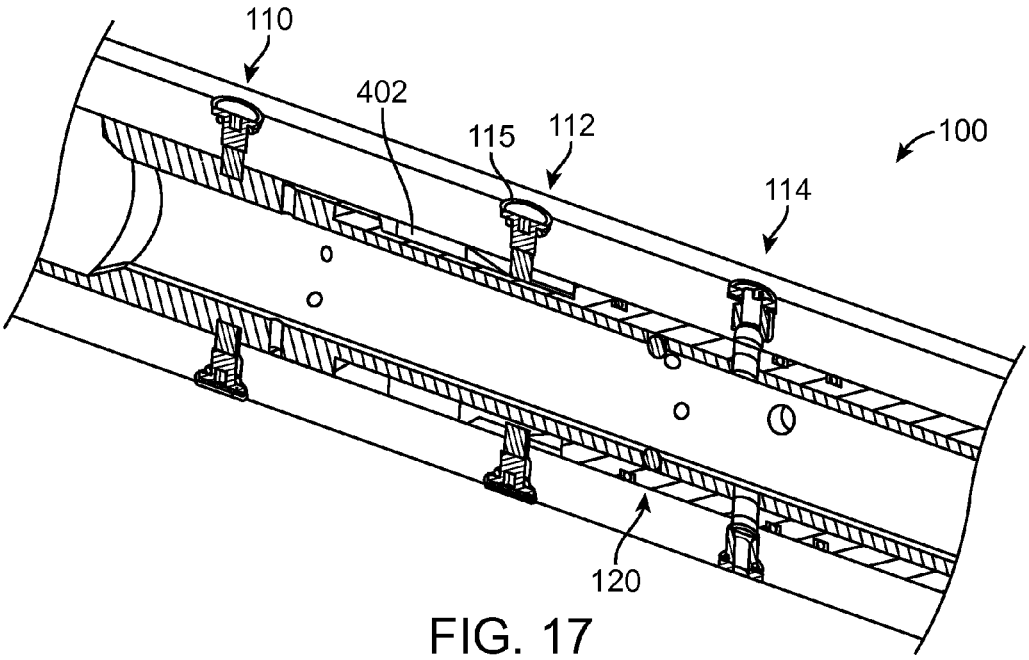
FIG. 17 is another cross-sectional view of the flow control mechanism of FIG. 15.

In order to further illustrate the first open configuration, FIGS. 16 and 17 are provided. FIG. 16 is a partial perspective view of that in FIG. 15, and FIG. 17 is another cross-sectional view of that in FIG. 15.

Figure 18:
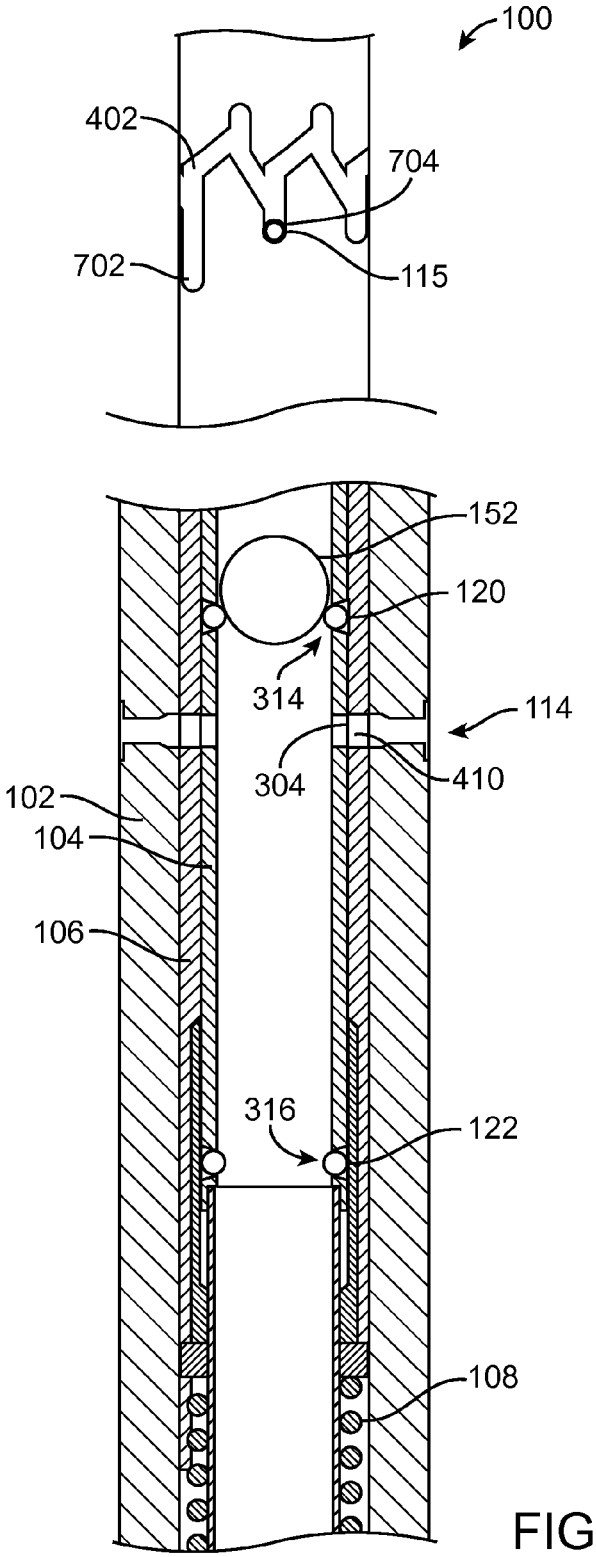
FIG. 18 is a cross-sectional view of a flow control mechanism in the first open configuration, with a second activation ball being seated in the first ball seat in accordance with an example embodiment.

FIG. 18 is a cross-sectional view of a flow control mechanism 100 in the first open configuration, with a second activation ball 152 being seated in the first ball seat 314 in accordance with an example embodiment. As illustrated, a second activation ball 152 has been received in the flow control mechanism 100. The operator of the well will send the second activation ball 152, when the operator wishes to change the flow configuration from the first open configuration to the second open configuration. Once the second activation ball 152 is received at the first seat 314, the pressure can build uphole relative to the second activation ball 152. As described above, once the pressure uphole of the activation ball 152 exceeds the pressure supplied by the biasing mechanism 108, the rotatable sleeve 106 can translate and rotate from the first open configuration position 704 along the path of the rotating sleeve pin within the slot 402.

Figure 19:
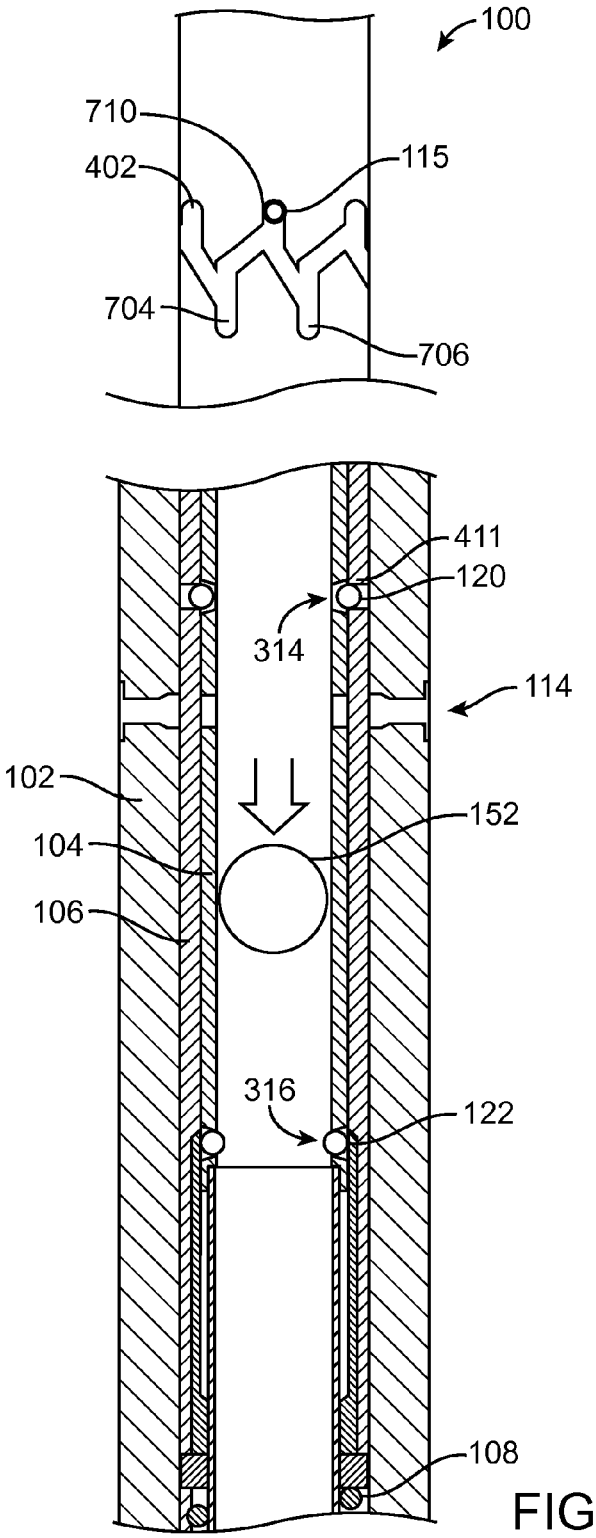
FIG. 19 is a cross-sectional view of a flow control mechanism being repositioned from the first open configuration, where the second activation ball is unseated from first ball seat in accordance with an example embodiment.

FIG. 19 is a cross-sectional view of a flow control mechanism 100 being repositioned from the first open configuration, where the second activation ball 152 is unseated from first ball seat 314, in accordance with an example embodiment.

As shown in FIG. 19, this movement aligns a first set of ball receiving apertures 411 of the rotatable sleeve 106 with the first set of balls 120. The alignment causes the first set of balls 120 to retract outward and move at least partially into the rotatable sleeve 106. Thus, the second activation ball 152 can be unseated from the first ball seat 314, and the second activation ball 152 drops to the second ball seat 316. The fluid pressure upstream is therefore stopped as all of the fluid can flow through at least the first set of flow ports 114 into an annulus around the flow control mechanism 100. When a second set of flow ports 116 are provided, the second set of flow ports can also be located upstream the second ball seat 316. Alternatively, the second flow ports 114 can be located downstream of the flow ports 114 and restricted from flowing in this configuration. This arrangement of the first set of flow ports 116 can enable the biasing mechanism 108 to return the rotatable sleeve 106 uphole to the second open configuration notch position.

Figure 20:
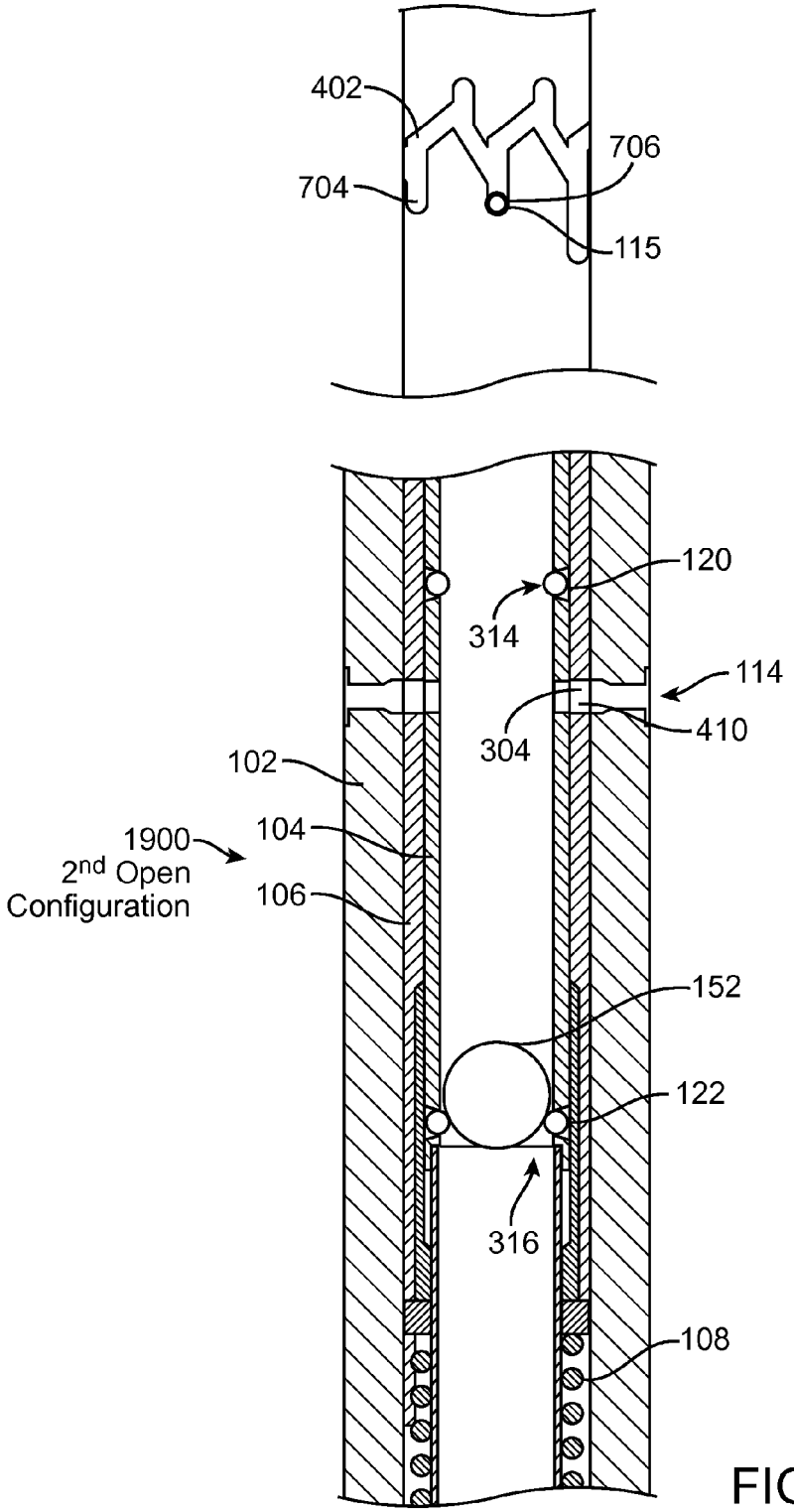
FIG. 20 is a cross-sectional view of a flow control mechanism in a second open configuration, repositioned from the first open configuration, where the second activation ball is seated in a second ball seat in accordance with an example embodiment.

FIG. 20 is a cross-sectional view of a flow control mechanism 100 in a second open configuration 1900, repositioned from the first open configuration, where the second activation ball 152 is seated in a second ball seat 316 in accordance with an example embodiment. As illustrated, the rotating sleeve pin 115 is positioned in the second open configuration notch position 706 of the slot 402 from the first open configuration notch position 704 after passing through the intermediary notch position of the slot 402. In the second open configuration, the upper port apertures 304 of the inner liner 104 align with the top set of apertures 410 of the rotatable sleeve 106 and the first set of flow ports 114 of the housing, thereby allowing fluid to flow in a substantially radial direction and into an annulus around the flow control mechanism 100. The seating of the second activation ball 152 can be maintained in the second open configuration 1900, thereby preventing fluid flow in an axial direction.

Figure 21:
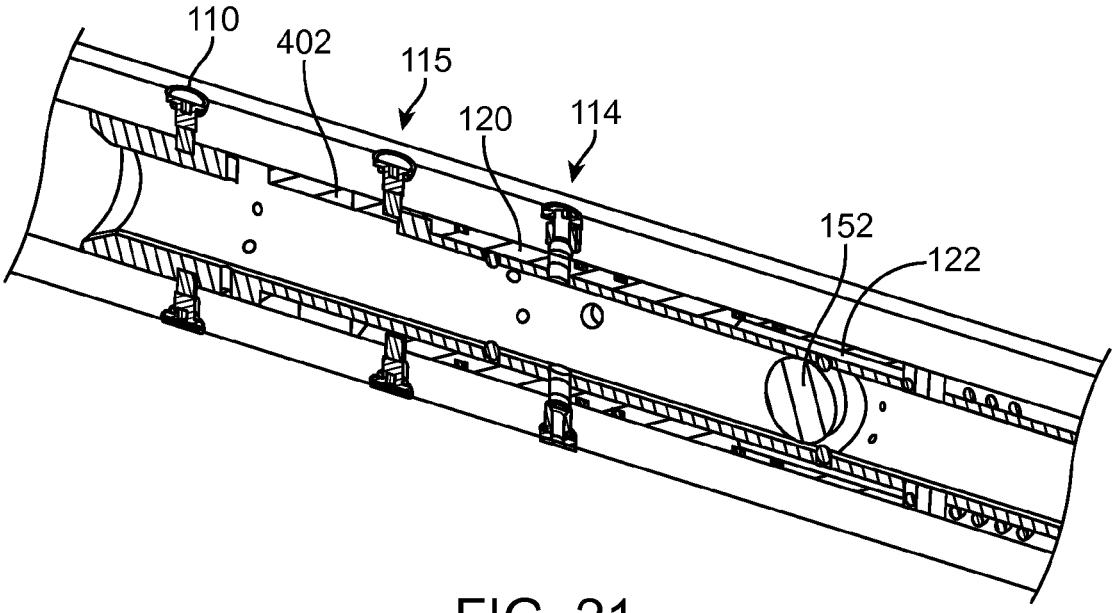
FIG. 21 is a partial perspective view of the flow control mechanism of FIG. 18.

FIG. 21 is a partial perspective view of that in FIG. 18. As illustrated, in FIG. 21, the first set of flow ports are configured to receive fluid uphole relative to the second activation ball 152 that is seated on the second set of balls 122. The second activation ball 152 prevents the axial flow of fluid through the flow control mechanism 100.

Figure 22:
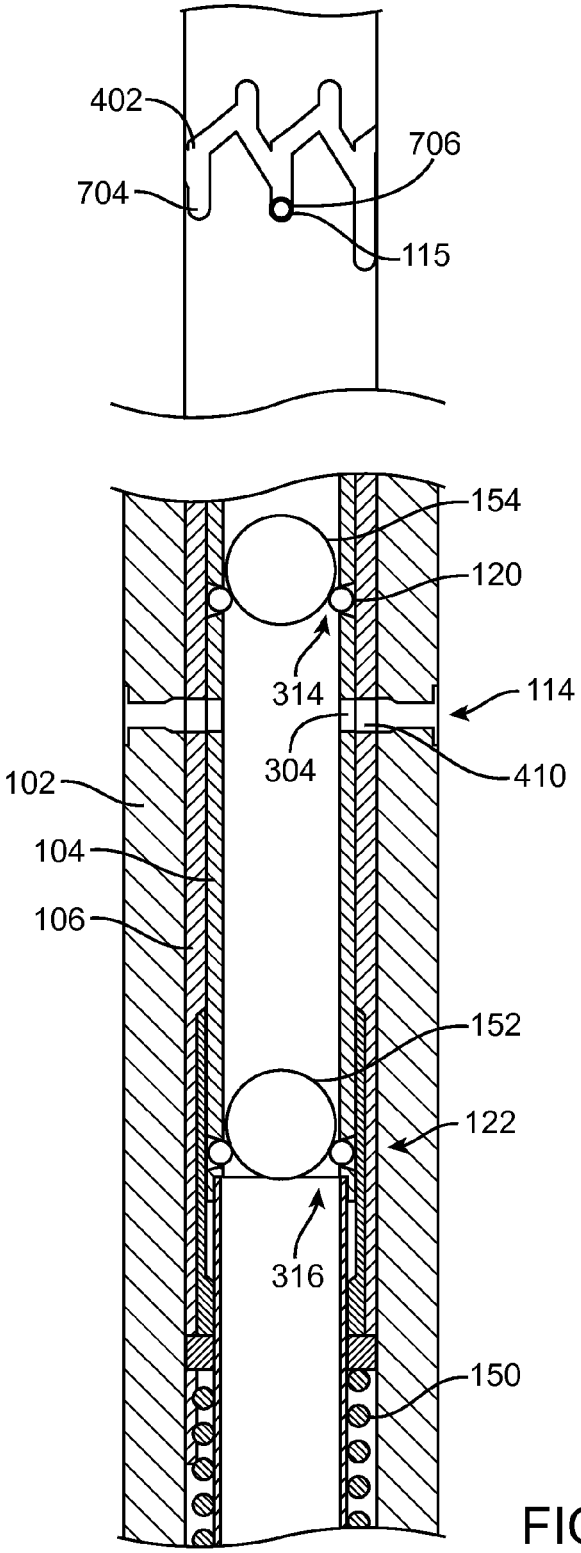
FIG. 22 is a cross-sectional view of a flow control mechanism being repositioned from the second open configuration, where a third activation ball is dropped and seated in the first ball seat and the second activation ball remains seated in the second ball seat in accordance with an example embodiment.

FIG. 22 is a cross-sectional view of a flow control mechanism being repositioned from the second open configuration, where a third action ball 154 is dropped and seated in the first ball seat 314 and the second activation ball 152 remains seated in the second ball seat 316 in accordance with an example embodiment. The closed configuration can be reestablished from the second open configuration in response to the third activation ball 154 being dropped into the flow control mechanism. The closed configuration can be reestablished when pressure uphole relative to the third activation ball 154 builds to overcome the pressure provided the biasing mechanism 108.

As the pressure builds as described above, the rotating sleeve pin 115 follows the path of the slot from the second open configuration notch position 706 to return to the closed configuration notch position. In this transition, the rotatable sleeve 106 rotates and translates in the axial direction. As the rotatable sleeve 106 rotates and translates, the third activation ball 154 is unseated from the first ball seat 314 as the first set of balls 120 retract. Also, the second activation ball 152 is unseated from the second ball seat 316 and allowed to pass through the flow control mechanism 100. The third activation ball is completely allowed to pass through the flow control mechanism 100 as well.

Thus, a balldrop-controlled flow control mechanism for a downhole tool has been described. The flow control mechanism includes a housing, an inner liner, and a rotatable sleeve. The inner liner is provided in and remains stationary relative the housing. The rotatable sleeve is arranged to rotate about the inner liner to provide a closed configuration, a first open configuration, and a second open configuration. The closed configuration can be configured to enable through-flow of fluid through the flow control mechanism to a distal tool. The first open configuration can be configured to enable partial through-flow of fluid through the flow control mechanism to a distal tool and partial through-flow of fluid in a substantially radial direction into an annulus around the flow control mechanism. The second open configuration is configured to prevent through-flow of fluid through the flow control mechanism to a distal tool and to enable through-flow of fluid in a substantially radial direction into an annulus around the flow control mechanism.

Figure 23:
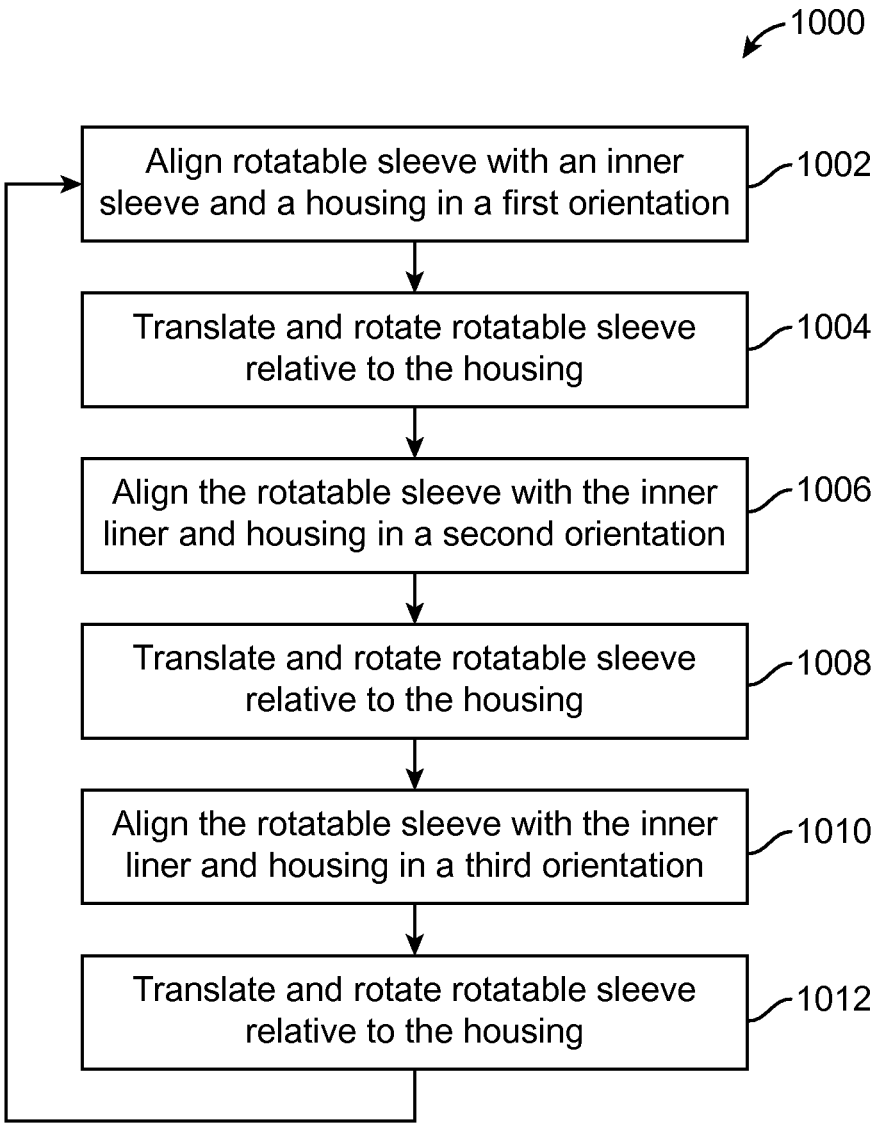
FIG. 23 is a flowchart for use in describing a method of controlling fluid flow with use of a flow control mechanism in accordance with an example embodiment.

FIG. 23 illustrates an exemplary embodiment of a method 1000 according to the present disclosure. The method 1000 is an example, as there are a variety of ways to carry out the method. The method 1000 can be carried out using the flow control mechanism for a downhole tool as described above. Each block shown in FIG. 23 can represent one or more processes, methods or subroutines carried out in the example method 1000. The method 1000 as presented in FIG. 23 can also be combined with the features of the method described above in FIG. 7.

A method is presented herein to control flow in a downhole tool. The method comprises translating and rotating a rotable sleeve, coupled to a housing by a pin and a slot, in response to pressure uphole of a ball seat. The method further includes aligning the rotatable sleeve with an inner liner and the housing to form a closed configuration, a first open configuration and a second open configuration.

The closed configuration can allow through-flow of fluid through the inner liner. The first open configuration can allow through-flow of fluid through the inner liner and through one or more flow ports. The second open configuration can allow fluid flow only through the one or more flow ports.

The closed, first open, and second open configuration can be arranged such that the order of the configurations can be set based on the slot and pin arrangement as described above. Additionally, the starting configuration can be set during the assembly process or the starting point can be set in the field through a series of activiations prior to inserting the flow control mechanism in the casing or borehole.

The method can further comprise biasing the rotatable sleeve in an uphole direction. The method can further comprise receiving a first ball at the ball seat. Additionally, the method can comprise translating the rotatable sleeve in an axial direction in response to pressure uphole of the ball seat. The method can further comprise rotating the rotatable sleeve relative to the housing based upon movement of the pin in the slot. Still further, the method can include aligning the one or more flow ports with apertures formed in the rotatable sleeve. The method can also include passing the first ball through the inner sleeve. Thus, the flow control mechanism is established in the first open configuration.

The method can also include receiving a second ball at the ball seat. The method can translate the rotatable sleeve in an axial direction in response to pressure uphole of the ball seat. The method can rotate the rotatable sleeve relative to the housing based upon movement of the pin in the slot. The method can include aligning the one or more flow ports with apertures formed in the rotatable sleeve. Additionally, the method can include retaining the second ball at a lower ball seat after the ball has passed by the ball seat. Thus, the flow control mechanism is established in the second open configuration.

The method can further include receiving a third ball at the ball seat. The method can comprise translating the rotatable sleeve in an axial direction and rotating the rotatable sleeve in response to pressure uphole of the ball seat. The rotation can be controlled based upon movement of the pin in the slot. The method can comprise passing the second ball and the third ball through the inner liner so as to return to the closed configuration.

As illustrated in FIG. 23, the method 1000 can start with aligning a rotatable sleeve with an inner sleeve and a housing in the first orientation (block 1002). The alignment of the rotatable sleeve with the inner sleeve can be done when the tool is assembled, before it is sent downhole or during a procedure once the tool is downhole. The alignment of the rotatable sleeve with the inner sleeve and the housing can allow for an initial desired flow configuration. For example, flow control mechanism can be aligned in a first orientation.

The method can further include translating and rotating the rotatable sleeve relative to the housing (block 1004). The translating and rotating of the rotatable sleeve relative to the housing can be in response to receiving a first ball at a ball seat. Once the first ball is received at the ball seat, the first ball can substantially block flow in an axial direction through the inner liner. As the flow is blocked pressure can build in an uphole direction relative to the ball seat. The pressure can cause the rotating sleeve to move downhole relative to a rest position. The downhole motion is resisted by a biasing mechanism. In at least one embodiment, the biasing mechanism can be a spring biasing mechanism. In another embodiment, the biasing mechanism can be a hydraulic mechanism.

The rotation and translation of the rotatable sleeve relative to the housing can be controlled based upon a slot and a corresponding pin. In at least one example, the slot can be formed on the rotatable sleeve and the pin can be coupled to the housing. In other embodiments, the pin can be coupled to the rotatable sleeve and the slot can be formed in the housing.

As indicated above, the slot can be configured to have a combined rotation and translation over at least a portion. Additionally, the slot can be configured to have a portion that only provides for translation of the rotatable sleeve relative to the housing. While the slot illustrated herein does not include a rotating only portion, the present disclosure applies to a slot that includes a rotating only portion. When the rotatable sleeve rotates and translates relative to the housing, the ports of the housing and the port apertures of the inner liner can be decoupled from one another by the orientation of the rotatable sleeve. In other embodiments, the rotatable sleeve can have apertures from therein that allow for fluid coupling of the ports of the housing and the port apertures of the inner liner over at least a portion of the rotation and/or translation.

The first ball that is received at the ball seat can pass by the ball seat. The first ball can pass by the ball seat during the rotation and translation in one embodiment. In another embodiment, the first ball does not pass by the ball seat until after the translation and rotation is complete. The ball seat can be configured as explained above. In at least one embodiment, the port apertures of the inner liner can be located downhole relative to the ball seat. After the first ball passes the ball seat, the first ball can continue to pass through the inner sleeve thereby allowing flow in an axial direction. In another embodiment, the first ball can be retained by a lower ball seat and block the flow. The arrangement for blocking the flow will be further described below but can be implemented as the second orientation in at least one embodiment. In one example, the first ball can be retained at the ball seat until a second orientation of the rotatable sleeve with inner liner and housing is established, and then, the first ball can pass by the ball seat.

The method can further include aligning the rotatable sleeve with the inner liner and housing in a second orientation (block 1006). The alignment of the rotatable sleeve with the inner liner and housing can be such that the ports of the housing and the port apertures of the inner liner are coupled by apertures formed in the rotatable sleeve. Thus in the second orientation, fluid can flow from inside of the inner liner through a sidewall of the inner sleeve, through a sidewall of the rotatable sleeve and through the sidewall of the housing and thereby exit the tool. In one embodiment, the second orientation can be a first open configuration, as described above, the fluid can flow in a substantially axial direction through the inner liner as well as being diverted through the sidewall of the housing.

The method can further include translating and rotating the rotatable sleeve relative to the housing (block 1008). The translation and rotation of the rotatable sleeve can be in response to receiving a second ball at the ball seat. As described above once the second ball is received at the ball seat, the second ball can substantially block flow in an axial direction through the inner liner. As the flow is blocked pressure can build in an uphole direction relative to the ball seat. The pressure can cause the rotating sleeve to move downhole relative to a rest position. The downhole motion is resisted by a biasing mechanism. In at least one embodiment, the biasing mechanism can be a spring biasing mechanism. In another embodiment, the biasing mechanism can be a hydraulic mechanism.

The rotation and translation of the rotatable sleeve relative to the housing can be controlled based upon a slot and a corresponding pin. In at least one example, the slot can be formed on the rotatable sleeve and the pin can be coupled to the housing. In other embodiments, the pin can be coupled to the rotatable sleeve and the slot can be formed in the housing.

As indicated above, the slot can be configured to have a combined rotation and translation over at least a portion. Additionally, the slot can be configured to have a portion that only provides for translation of the rotatable sleeve relative to the housing. While the slot illustrated herein does not include a rotating only portion, the present disclosure applies to a slot that includes a rotating only portion. When the rotatable sleeve rotates and translates relative to the housing, the ports of the housing and the port apertures of the inner liner can be decoupled from one another by the orientation of the rotatable sleeve. In other embodiments, the rotatable sleeve can have apertures from therein that allow for fluid coupling of the ports of the housing and the port apertures of the inner liner over at least a portion of the rotation and/or translation.

The second ball that is received at the ball seat can pass by the ball seat and be received at a lower ball seat. The lower ball seat retains the second ball and blocks flow in a substantially axial direction, but allows flow through the port apertures of the inner liner. The ball seat can be configured as explained above. In at least one embodiment, the port apertures of the inner liner can be located downhole relative to the ball seat. In one example, the second ball can be retained at the ball seat until a third orientation of the rotatable sleeve with inner liner and housing is established. The second ball then can then pass by the inner liner port apertures and then be seated at the lower ball seat.

The method can further include aligning the rotatable sleeve with the inner liner and housing in a third orientation (block 1010). The alignment of the rotatable sleeve with the inner liner and housing can be such that the ports of the housing and the port apertures of the inner liner are coupled by apertures formed in the rotatable sleeve. Thus in the second orientation, fluid can flow from inside of the inner liner through a sidewall of the inner sleeve, through a sidewall of the rotatable sleeve and through the sidewall of the housing and thereby exit the tool. In one embodiment, the fluid third orientation can be a second open configuration, as described above, the fluid can be diverted through the sidewall of the housing with little or no flow in the axial direction.

The method can further include translating and rotating the rotatable sleeve relative to the housing (block 1012). The translation and rotation can be in response to receiving a third ball at the ball seat. As indicated above, the translation and rotation of the rotatable sleeve can be simultaneous, independent or a combination thereof. During the translation and rotation, the ports of the housing and the port apertures of the inner linear can be decoupled from one another based upon the position of the rotatable sleeve. The translation and rotation of the rotatable sleeve can be in dependence upon the configuration of the slot. The third ball can pass the ball seat and the second ball can pass the lower ball seat during the translation and rotation or after the translation and rotation is complete. In one example the third ball and second ball are retained until the rotatable sleeve reaches its next orientation relative to the housing.

In at least one embodiment, the method can continue to a next orientation of the rotatable sleeve relative to the housing. The next orientation can be the first orientation or a fourth orientation. When the method returns the rotatable sleeve to the first orientation relative to the housing, a total of three different orientations can be provided. In other embodiments where a greater number of orientations are desired the rotatable sleeve can return to the first orientation after the total number of desired orientations have been completed.

In at least one embodiment, the first orientation can be the closed configuration. In at least one embodiment, the second orientation can be the first open configuration. Additionally, the third orientation can be the second open configuration. In other embodiments, the orientations can be arranged to provide different configurations or a different order of the configurations.

As presented herein the disclosure includes a flow control mechanism for a downhole tool, comprising a housing; an inner liner provided in and remaining stationary relative the housing; a rotatable sleeve arranged to rotate about the inner liner; a slot formed around the rotatable sleeve and having a plurality of notch positions; the rotatable sleeve being set in position by a pin which extends from the housing into the slot, each notch position corresponding to one of a plurality of operating configurations of the mechanism, the operating configurations including a closed configuration, a first open configuration, and a second open configuration; the closed configuration configured to enable through-flow of fluid through the inner liner; the first open configuration configured to enable through-flow of fluid through the inner liner and through one or more flow ports; and the second open configuration configured to enable fluid flow only through the one or more flow ports.

In at least one embodiment, the flow control mechanism can further comprise a first retractable ball seat comprising a first set of balls exposable in the inner liner.

In at least one embodiment, the flow control mechanism can further comprise a second retractable ball seat comprising a second set of balls exposable in the inner liner and downstream from the first set of balls.

In at least one embodiment, the flow control mechanism can further comprise a biasing mechanism coupled to and extending from the rotatable sleeve, the biasing mechanism being configured to bias the rotatable sleeve in the upstream direction.

In at least one embodiment, the flow control mechanism can further comprise a biasing mechanism coupled to and extending from the rotatable sleeve, the biasing mechanism being configured to bias the rotatable sleeve in the uphole direction; the rotatable sleeve being pushed downstream by fluid pressure when an actuation ball is seated on the first retractable ball seat to block through-flow of fluid through the inner liner; and the rotatable sleeve being pushed back upstream by the biasing mechanism when the first retractable ball seat has released the actuation ball.

In at least one embodiment, the flow control mechanism wherein a first actuation ball is restricted from passage by the first retractable ball seat, thereby restricting flow through the inner liner and increasing fluid pressure upstream of first retractable ball seat, thereby pushing the rotatable sleeve from a retained position to an unretained position.

In at least one embodiment, the flow control mechanism wherein the first retractable ball seat releases the first actuation ball and the rotatable sleeve rotates further and enables the biasing mechanism to push back the rotatable sleeve to a second retained position, wherein the one or more ports align with corresponding apertures formed in the rotatable sleeve.

In at least one embodiment, the flow control mechanism wherein a second ball is received at the first retractable ball seat and upon rotation to an intermediate position, the second ball is received at the second retractable ball seat, thereby blocking through-flow of fluid through the inner liner while allowing the fluid to flow through the one or more ports.

In at least one embodiment, the flow control mechanism wherein a third ball is received at the first retractable ball seat.

In at least one embodiment, the flow control mechanism wherein the slot is a J-slot wherein the plurality of notch positions comprises an upper notch positions and lower notch positions.

In at least one embodiment, the flow control mechanism wherein the lower notch positions have two different lengths, a long length and a short length.

In at least one embodiment, the flow control mechanism wherein there is one long length notch for every two short length notches.

In at least one embodiment, the flow control mechanism wherein each of the long length notch and the short length notch have a portion that is substantially longitudinal with respect to a longitudinal axis of the mechanism.

In at least one embodiment, the flow control mechanism wherein one or more flow ports include at least one upper flow port and at least one lower flow port being located downhole relative to the upper flow port.

In at least one embodiment, the flow control mechanism wherein the at least one upper flow port is at a different azimuthal direction relative to the at least one lower flow port.

In at least one embodiment, the flow control mechanism wherein the at least one upper flow port comprises four upper flow ports and the at least one lower flow port comprises four lower flow ports.

In at least one embodiment, the flow control mechanism wherein the slot includes a circumferential portion and at least one axial portion, thereby allowing the rotatable sleeve to rotate and translate and exclusively translate.

The present disclosure can also include embodiments that incorporate one or more of the features as described above into the flow control mechanism.

Additionally, the flow control mechanism can be implemented as part of a downhole tool. Still further, the flow control mechanism can be included in a drill string.

The present disclosure also includes one or more methods. In one embodiment, the present disclosure provides a method to control flow in a downhole tool, the method comprising translating and rotating a rotatable sleeve, coupled to a housing by a pin and a slot, in response to pressure uphole of a ball seat; aligning the rotatable sleeve with an inner liner and the housing to form a closed configuration, a first open configuration and a second open configuration, and wherein: the closed configuration allows through-flow of fluid through the inner liner, the first open configuration allows through-flow of fluid through the inner liner and through one or more flow ports, and the second open configuration allows fluid flow only through the one or more flow ports.

In at least one embodiment, the method further comprises biasing the rotatable sleeve in an uphole direction; receiving a first ball at the ball seat; translating the rotatable sleeve in an axial direction in response to pressure uphole of the ball seat; rotating the rotatable sleeve relative to the housing based upon movement of the pin in the slot; aligning the one or more flow ports with apertures formed in the rotatable sleeve; and passing the first ball through the inner sleeve.

In at least one embodiment, the method further comprises receiving a second ball at the ball seat; translating the rotatable sleeve in an axial direction in response to pressure uphole of the ball seat; rotating the rotatable sleeve relative to the housing based upon movement of the pin in the slot; aligning the one or more flow ports with apertures formed in the rotatable sleeve; and retaining the second ball at a lower ball seat after the ball has passed by the ball seat.

The method can also include other processes, steps or procedures in order to carry out the above operation of the apparatus. The method can be implemented as part of operation of a tool, a drill string, or a drilling operation.

The embodiments shown and described above are only examples. Many details are often found in the art such as the other features of a flow control mechanism for a tool. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure to the full extent indicated by the broad general meaning of the terms used in the attached claims. It will therefore be appreciated that the embodiments described above can be modified within the scope of the appended claims.

What is claimed is:

1. A flow control mechanism for a downhole tool, comprising:

a housing an inner liner provided in and remaining stationary relative to the housing;

a rotatable sleeve arranged to rotate about the inner liner;

a slot formed around the rotatable sleeve and having a plurality of notch positions;

the rotatable sleeve being set in position by a pin which extends from the housing into the slot, each notch position corresponding to one of a plurality of operating configurations of the mechanism, the operating configurations including a closed configuration, a first open configuration, and a second open configuration;

the closed configuration configured to enable through-flow of fluid through the inner liner;

the first open configuration configured to enable through-flow of fluid through the inner liner and through one or more flow ports; and the second open configuration configured to enable fluid flow only through the one or more flow ports.

2. The flow control mechanism of claim 1, further comprising:

a first retractable ball seat comprising a first set of balls exposable in the inner liner.

3. The flow control mechanism of claim 2, further comprising:

a second retractable ball seat comprising a second set of balls exposable in the inner liner and downstream from the first set of balls.

4. The flow control mechanism of claim 3, further comprising:

a biasing mechanism coupled to and extending from the rotatable sleeve, the biasing mechanism being configured to bias the rotatable sleeve in the upstream direction.

5. The flow control mechanism of claim 2, further comprising:

a biasing mechanism coupled to and extending from the rotatable sleeve, the biasing mechanism being configured to bias the rotatable sleeve in the uphole direction;

the rotatable sleeve being pushed downstream by fluid pressure when an actuation ball is seated on the first retractable ball seat to block through-flow of fluid through the inner liner; and the rotatable sleeve being pushed back upstream by the biasing mechanism when the first retractable ball seat has released the actuation ball.

6. The flow control mechanism of claim 4, wherein a first actuation ball is restricted from passage by the first retractable ball seat, thereby restricting flow through the inner liner and increasing fluid pressure upstream of first retractable ball seat, thereby pushing the rotatable sleeve from a retained position to an unretained position.

7. The flow control mechanism of claim 6, wherein the first retractable ball seat releases the first actuation ball and the rotatable sleeve rotates further and enables the biasing mechanism to push back the rotatable sleeve to a second retained position, wherein the one or more ports align with corresponding apertures formed in the rotatable sleeve.

8. The flow control mechanism of claim 7, wherein a second ball is received at the first retractable ball seat and upon rotation to an intermediate position, the second ball is received at the second retractable ball seat, thereby blocking through-flow of fluid through the inner liner while allowing the fluid to flow through the one or more ports.

9. The flow control mechanism of claim 8, wherein a third ball is received at the first retractable ball seat.

10. The flow control mechanism of any one of claim 1, wherein the slot is a J-slot wherein the plurality of notch positions comprise upper notch positions and lower notch positions.

11. The flow control mechanism of claim 10, wherein the lower notch positions have two different lengths, a long length and a short length.

12. The flow control mechanism of claim 11, wherein there is one long length notch for every two short length notches.

13. The flow control mechanism of claim 11, wherein each of the long length notch and the short length notch have a portion that is substantially longitudinal with respect to a longitudinal axis of the mechanism.

14. The flow control mechanism of any one of claim 1, wherein one or more flow ports include at least one upper flow port and at least one lower flow port being located downhole relative to the upper flow port.

15. The flow control mechanism of claim 14, wherein the at least one upper flow port is at a different azimuthal direction relative to the at least one lower flow port.

16. The flow control mechanism of claim 15, wherein the at least one upper flow port comprises four upper flow ports and the at least one lower flow port comprises four lower flow ports.

17. The flow control mechanism of any one of claim 1, wherein the slot includes a circumferential portion and at least one axial portion, thereby allowing the rotatable sleeve to rotate and translate and exclusively translate.

18. A method to control flow in a downhole tool, the method comprising:

translating and rotating a rotatable sleeve, coupled to a housing by a pin and a slot, in response to pressure uphole of a ball seat;

aligning the rotatable sleeve with an inner liner and the housing to form a closed configuration, a first open configuration and a second open configuration, and wherein:

the closed configuration allows through-flow of fluid through the inner liner, the first open configuration allows through-flow of fluid through the inner liner and through one or more flow ports, and the second open configuration allows fluid flow only through the one or more flow ports.

19. The method as recited in claim 18, further comprising:

biasing the rotatable sleeve in an uphole direction;

receiving a first ball at the ball seat;

translating the rotatable sleeve in an axial direction in response to pressure uphole of the ball seat;

rotating the rotatable sleeve relative to the housing based upon movement of the pin in the slot;

aligning the one or more flow ports with apertures formed in the rotatable sleeve; and passing the first ball through the inner sleeve.

20. The method as recited in claim 19, further comprising:

receiving a second ball at the ball seat;

translating the rotatable sleeve in an axial direction in response to pressure uphole of the ball seat;

rotating the rotatable sleeve relative to the housing based upon movement of the pin in the slot;

aligning the one or more flow ports with apertures formed in the rotatable sleeve; and retaining the second ball at a lower ball seat after the ball has passed by the ball seat.

* * * * *